US008298741B2

(12) United States Patent
Yoshida et al.

(10) Patent No.: US 8,298,741 B2
(45) Date of Patent: Oct. 30, 2012

(54) IMAGE FORMING APPARATUS AND IMAGE FORMING METHOD

(75) Inventors: Satoshi Yoshida, Kanagawa (JP); Eisuke Iwazaki, Kanagawa (JP); Shintaro Anno, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 128 days.

(21) Appl. No.: 12/909,331

(22) Filed: Oct. 21, 2010

(65) Prior Publication Data

US 2011/0300477 A1 Dec. 8, 2011

(30) Foreign Application Priority Data

Jun. 7, 2010 (JP) ..... 2010-129864

(51) Int. Cl.
*G03G 13/06* (2006.01)

(52) U.S. Cl. ..... 430/123.52; 430/108.1; 430/108.24; 430/108.3; 430/109.4; 430/123.5; 430/123.54; 430/123.55; 399/252

(58) Field of Classification Search ..... 430/108.1, 430/108.24, 108.3, 109.4, 123.5, 123.52, 430/123.54, 123.55; 399/252
See application file for complete search history.

(56) References Cited

U.S. PATENT DOCUMENTS 6,221,548 B1 4/2001 Shiba et al.

FOREIGN PATENT DOCUMENTS

JP A 4-333868 11/1992
JP A 9-146333 6/1997
JP A 2005-077850 3/2005

*Primary Examiner* — Peter Vajda
(74) *Attorney, Agent, or Firm* — Oliff & Berridge, PLC

(57) ABSTRACT

An image forming apparatus includes plural developing units separately containing a toner A and a toner B that satisfy relationships (1) and (2) and have similar colors. The toner A and the toner B each contain a binder resin containing a polyester about 90 mass % or more of the binder resin, and about 90 mass % of the binder resin of the toner A and about 90 mass % of the binder resin of the toner B are the same resin. The polyester contains an amorphous polyester having an alkyl side chain and a crystalline polyester. The relationship (1) is Ta (toner A)>Tb (toner B) in terms of flow tester ½ effluent temperature. The relationship (2) is Aa (toner A)>Ab (toner B) in terms of an amount of an aluminum (with reference to net intensity) measured with fluorescent X-ray.

14 Claims, 1 Drawing Sheet

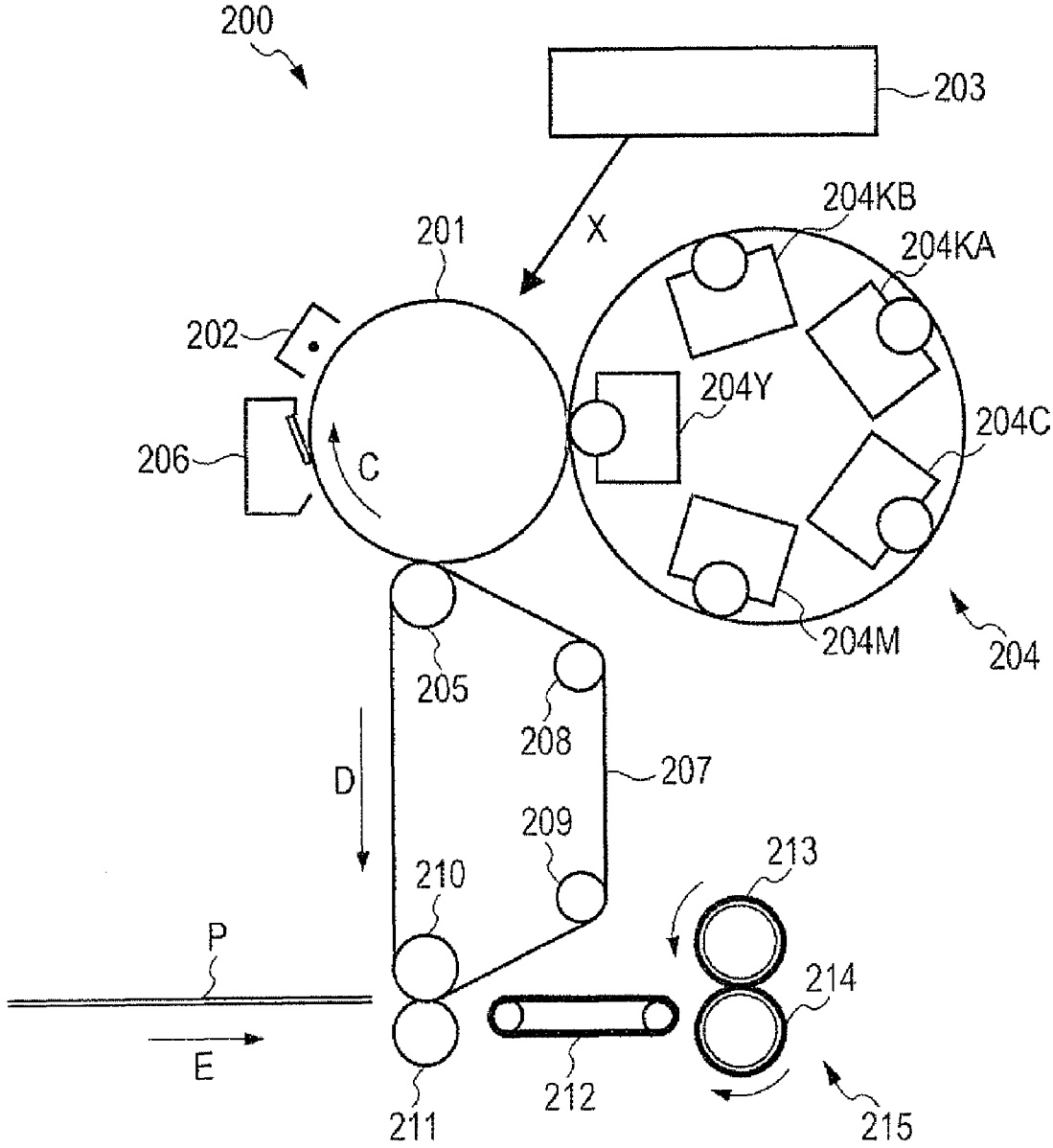
200
203
X
201
204KB
204KA
202
204Y
204C
206
C
204M
204
205
208
207
D
209
210
213
P
214
E
212
211
215

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2010-129864 filed Jun. 7, 2010.

BACKGROUND (i) Technical Field

The present invention relates to an image forming apparatus and an image forming method.

(ii) Related Art

Methods of visualizing (developing) image information through electrostatic images such as an electrophotographic method are currently used in various fields. In such an electrophotographic method, for example, an electrostatic latent image is formed (electrostatic latent image forming step) on an electrostatic-latent-image holding body by a charging and exposing step, a toner is supplied to develop the electrostatic latent image (developing step), the toner image formed by the development is transferred onto a recording medium through or not through an intermediate transfer member (transferring step), and the resultant transfer image is fixed (fixing step). Thus, image information is visualized.

In such an electrophotographic method, when a full-color image is formed, the color is generally reproduced with a combination of three color toners (yellow, magenta, and cyan, which are the three primary colors of coloring materials) or a combination of four color toners (the three primary colors and black). In such a case, an image having a secondary color such as red is formed by stacking a yellow toner and a magenta toner in an appropriate proportion.

SUMMARY

According to an aspect of the invention, there is provided an image forming apparatus including an electrostatic-latent-image holding member; a charging unit that charges the electrostatic-latent-image holding member; an electrostatic-latent-image forming unit that forms an electrostatic latent image on a surface of the charged electrostatic-latent-image holding member; plural developing units that each supply a developer containing a toner to the electrostatic latent image formed on the surface of the electrostatic-latent-image holding member and form a toner image; a transfer unit that transfers the toner image onto a recording medium to form a transfer image; and a fixing unit that fixes the transfer image, wherein the plural developing units separately contain a toner A and a toner B that satisfy relationships (1) and (2) below and have similar colors; the toner A includes a binder resin containing a polyester about 90 mass % or more of the binder resin, the polyester contains an amorphous polyester having an alkyl side chain and a crystalline polyester, and when a glass transition temperature of the amorphous polyester is defined as Tga, the crystalline polyester has a melting temperature Tma of about (Tga+10)° C. or more and about (Tga+30)° C. or less; the toner B contains a binder resin containing a polyester about 90 mass % or more of the binder resin, the polyester contains an amorphous polyester having an alkyl side chain and a crystalline polyester, and when a glass transition temperature of the amorphous polyester is defined as Tgb, the crystalline polyester has a melting temperature Tmb of about (Tgb+10)° C. or more and about (Tgb+30)° C. or less; and about 90 mass % of the binder resin of the toner A and about 90 mass % of the binder resin of the toner B are the same resin;

(1) relationship of Ta>Tb where Ta represents a flow tester ½ effluent temperature of the toner A and Tb represents a flow tester ½ effluent temperature of the toner B; and (2) relationship of Aa>Ab where Aa represents an amount of an aluminum (with reference to net intensity) in the toner A measured with fluorescent X-ray and Ab represents an amount of an aluminum (with reference to net intensity) in the toner B measured with fluorescent X-ray.

BRIEF DESCRIPTION OF THE DRAWING

Exemplary embodiment of the present invention will be described in detail based on the following FIGURE, wherein:

FIGURE is a schematic view illustrating the configuration of an image forming apparatus according to an exemplary embodiment of the present invention.

DETAILED DESCRIPTION

Hereinafter, an image forming apparatus and an image forming method according to exemplary embodiments of the invention will be described with reference to the image forming apparatus.

Configuration of Apparatus

FIGURE is a schematic view illustrating the configuration of an image forming apparatus according to an exemplary embodiment of the invention. In this exemplary embodiment, the image forming apparatus is an intermediate-transfer-system image forming apparatus that performs transfer via an intermediate transfer member; and includes a first transfer section that transfers a developed toner image to the intermediate transfer member and a second transfer section that transfers the transferred toner image on the intermediate transfer member to a recording material. The image forming apparatus according to the exemplary embodiment also includes a cleaning section that removes toner remaining on the surface of an electrostatic-latent-image holding member after the transfer performed by the first transfer section.

An image forming apparatus 200 according to the exemplary embodiment includes an electrostatic-latent-image holding member 201; a charging device 202 (charging section); an exposure device 203 (an electrostatic-latent-image forming section); a rotary developing unit 204 including plural developed-image forming devices (developing devices); a first transfer roller 205 in the first transfer section (transfer section); a cleaning device 206 including a cleaning blade (cleaning section); an intermediate transfer member 207 collectively transfers superimposed toner images of plural colors onto recording paper (recording medium) P; three support rollers 208, 209, and 210 that stretch and support, together with the first transfer roller 205, the intermediate transfer member 207; a second transfer roller 211 in the second transfer section (transfer section); a transport belt 212 that transports the recording paper P after the second transfer; a fixing device (fixing section) 215 that nips between a heating roller 213 and a pressure roller 214 the recording paper P having been transported by the transport belt 212 and fixes toner images by heat and pressure; and the like.

The electrostatic-latent-image holding member 201 generally has the shape of a drum and includes a photosensitive layer in the outer circumferential surface (drum surface). The electrostatic-latent-image holding member 201 is provided so as to be rotatable in the direction represented by arrow C in FIGURE. The charging device 202 uniformly charges the surface of the electrostatic-latent-image holding member 201. The exposure device 203 exposes the electrostatic-latent-image holding member 201 uniformly charged by the charging device 202, with light X corresponding to an image to thereby form an electrostatic latent image.

The rotary developing unit 204 has five developing devices (developed-image forming devices) 204Y, 204M, 204C, 204KA, and 204KB respectively containing toners for yellow, magenta, cyan, first black, and second black. In the apparatus according to the exemplary embodiment, the developing device 2041 contains a yellow toner; the developing device 204M contains a magenta toner; the developing device 204C contains a cyan toner; the developing device 204KA contains a first black toner; and the developing device 204KB contains a second black toner, which is different from the first black toner. In the exemplary embodiment, the first black toner contained in the developing device 204KA and the second black toner contained in the developing device 204KB satisfy specific relationships, which will be described below.

The rotary developing unit 204 is driven to rotate such that the five developing devices 204Y, 204M, 204C, 204KA, and 204KB are sequentially made to closely face the electrostatic-latent-image holding member 201. Thus, the toners are transferred onto electrostatic latent images that correspond to the colors of the toners to thereby form toner images.

One or more of the developing devices other than the developing devices 204KA and 204KB in the rotary developing unit 204 may be removed in accordance with an image to be developed. For example, a rotary developing unit including four developing devices of the developing device 204Y, the developing device 204M, the developing device 204KA, and the developing device 204KB may be used. Such a developing device may be substituted with a developing device containing a developer having a desired color such as blue or green.

While the first transfer roller 205 and the electrostatic-latent-image holding member 201 nips the intermediate transfer member 207 therebetween, the first transfer roller 205 transfers (first transfer) toner images formed on the surface of the electrostatic-latent-image holding member 201 onto the outer peripheral surface of the intermediate transfer member 207 having the shape of an endless belt. The cleaning device 206 cleans off (removes) toner and the like remaining on the surface of the electrostatic-latent-image holding member 201 after the transfer. The inner peripheral surface of the intermediate transfer member 207 is stretched and supported by the plural support rollers 208, 209, and 210 and the first transfer roller 205 such that the intermediate transfer member 207 is capable of running around in the direction represented by arrow D or in the reverse direction. While the second transfer roller 211 and the support roller 210 nips therebetween the recording paper (recording medium) P transported in the direction represented by arrow E by a paper transport section (not shown), the second transfer roller 211 transfers (second transfer) toner images having been transferred onto the outer peripheral surface of the intermediate transfer member 207, onto the recording paper P.

The image forming apparatus 200 sequentially forms toner images on the surface of the electrostatic-latent-image holding member 201 and transfers the toner images so as to be superimposed onto the outer peripheral surface of the intermediate transfer member 207. The image forming apparatus 200 is operated in the following manner. The electrostatic-latent-image holding member 201 is driven to rotate and the surface of the electrostatic-latent-image holding member 201 is charged by the charging device 202 (charging step). Then, the electrostatic-latent-image holding member 201 is exposed to light corresponding to an image by the exposure device 203 to thereby form an electrostatic latent image (latent-image forming step).

The electrostatic latent image is developed by, for example, the developing device 204Y for yellow (developing step). Then, the yellow toner image is transferred onto the outer peripheral surface of the intermediate transfer member 207 by the first transfer roller 205 (first transfer step). At this time, toner that is not transferred onto the intermediate transfer member 207 and remains on the surface of the electrostatic-latent-image holding member 201 is cleaned by the cleaning device 206.

The intermediate transfer member 207 on the outer peripheral surface of which the yellow toner image has been formed is rotated one turn in the direction represented by arrow D while holding the yellow toner image on the outer peripheral surface (at this time, the electrostatic-latent-image holding member 201 is separated from the intermediate transfer member 207 and the cleaning device 206). Thus, the intermediate transfer member 207 is registered such that the next toner image such as a magenta toner image is to be transferred thereonto so as to be superimposed on the yellow toner image.

Then, similarly, the charging by the charging device 202, the exposure with light corresponding to an image by the exposure device 203, the formation of a toner image by the developing device 204M, 204C, 204KA, or 204KB, and the transfer of the toner image onto the outer peripheral surface of the intermediate transfer member 207 are sequentially performed for all the toners of magenta, cyan, first black, and second black.

In the exemplary embodiment, for example, to form a red image, a yellow toner image is formed on the intermediate transfer member 207 by the developing step and the first transfer step; and a magenta toner image formed on the electrostatic-latent-image holding member 201 by the developing device 204M is then transferred onto the yellow toner image by the first transfer step.

As described below, the first black toner has a low gloss and is used to form character images, whereas the second black toner has a high gloss and is used to form photographic images, high-resolution images, and full-color images. Accordingly, the first black toner is not superimposed on another toner and the first and second black toners are not disposed in the same region. Thus, for a single-image information, there are cases where only the first black toner is used, cases where toners other than the first black toner are appropriately combined and used, and cases where the first black toner is used for an image forming region and other toners are appropriately combined and used for another image forming region.

After the toner images corresponding to desired colors have been thus transferred onto the outer peripheral surface of the intermediate transfer member 207, the toner images are transferred by the second transfer roller 211 onto the recording paper P (second transfer step). As a result, in the case of a full-color-image region on the image forming surface of the recording paper P, a recording image in which, from the image forming surface, the second black toner image, the cyan toner image, the magenta toner image, and the yellow toner image are sequentially and appropriately superimposed is obtained. In the case of a character-image region, a recording image of the first black toner image is obtained. After such toner images have been transferred by the second transfer roller 211 onto the surface of the recording paper P, the transferred toner images are fixed by heating by the fixing device 215 (fixing step).

Whether the first black toner or the second black toner is used for a single-black-image information may be determined by, for example, automatically identifying an image whether the image is a character image or a photographic image on the basis of image information sent from a personal computer and selecting the corresponding toner. Alternatively, image information sent from a personal computer may be made to contain the information of a toner to be selected. Alternatively, for example, in the case of using a standard copier, a user of the copier may directly input the selection of a toner to be used for paper or image information or, furthermore, for an image region specified by the user.

Hereinafter, the charging section, the electrostatic-latent-image holding member, the electrostatic-latent-image forming section, the developed-image forming devices, the transfer section, the intermediate transfer member, the cleaning section, the fixing section, and a recording medium in the image forming apparatus 200 illustrated in FIGURE will be described.

Charging Section

The charging device 202 (the charging section), for example, a charging device such as a corotron may be used; or a conductive or semiconductive charging roller may be used. A contact charging device including a conductive or semiconductive charging roller may be used to apply direct current or direct current on which alternating current is superimposed, to the electrostatic-latent-image holding member 201. For example, by using such a charging device 202, electric discharge is caused in a micro-space in the vicinity of the contact area between the charging device 202 and the electrostatic-latent-image holding member 201 and, as a result, the surface of the electrostatic-latent-image holding member 201 is charged.

The charging section generally charges the surface of the electrostatic-latent-image holding member 201 in the range of −300 V or more and −1000 V or less. The conductive or semiconductive charging roller may have a monolayer structure or a multilayer structure. A mechanism that cleans the surface of such a charging roller may be further provided.

Electrostatic-latent-image Holding Member

The electrostatic-latent-image holding member 201 is a member on which a latent image (electrostatic charged image) is formed. As the electrostatic-latent-image holding member, an electrophotographic photoconductor may be suitably used. The electrostatic-latent-image holding member 201 has a structure in which a photoconductive layer including an organic photoconductive layer or the like is formed on the outer circumferential surface of a cylindrical conductive substrate. If necessary, an undercoat layer is formed on the surface of the substrate. In general, the photoconductive layer has a configuration in which a charge generation layer containing a charge generating material and a charge transport layer containing a charge transporting material are further formed in this order. The order of stacking the charge generation layer and the charge transport layer may be reversed.

Such a photoconductor is a multilayer photoconductor in which a charge generating material and a charge transporting material are made to be contained in separate layers (a charge generation layer and a charge transport layer) and the layers are stacked. Alternatively, a monolayer photoconductor in which both a charge generating material and a charge transporting material are made to be contained in a single layer may be used. A multilayer photoconductor is preferred. An intermediate layer may be further disposed between the undercoat layer and the photoconductive layer. The photoconductive layer is not necessarily an organic photoconductive layer and may be another photosensitive layer such as amorphous silicon photosensitive film or the like.

Electrostatic-latent-image Forming Section

The exposure device 203 (electrostatic-latent-image forming section) is not particularly limited. For example, the exposure device 203 may be an optical device that exposes the surface of the electrostatic-latent-image holding member by using a source of light such as semiconductor laser light, LED light, or liquid crystal shutter light such that the light corresponds to a desired image.

Developing Device

The developing device has a function of developing a latent image formed on the electrostatic-latent-image holding member, by using a developer containing a toner to thereby form a toner image. Such a developing device is not particularly limited as long as it has the above-described function and may be selected in accordance with a purpose. For example, such a developing device having a function of developing an electrostatically latent image on the electrostatic-latent-image holding member 201 with the toner by using a brush, a roller, or the like. When development is performed, a direct voltage is generally used for the electrostatic-latent-image holding member 201; however, an alternating voltage may be superimposed on the direct voltage.

Transfer Section

As the transfer section (in the exemplary embodiment, the term "transfer section" denotes both the first transfer section and the second transfer section), for example, a device that gives a charge from the back side of a recording medium, the charge having a polarity opposite to that of the toner of a toner image, to thereby transfer the toner image onto the front surface of the recording medium by an electrostatic force; or a transfer roller and transfer-roller pressing device that includes, for example, a conductive or semiconductive roller that is made to be brought into direct contact with the back surface of a recording medium to thereby transfer a toner image onto the front surface of the recording medium may be used.

In such a transfer roller, as a transfer current imparted to the electrostatic-latent-image holding member, a direct current may be applied or a direct current on which an alternating current is superimposed may be applied. Various conditions and characteristics of a transfer roller may be appropriately determined in accordance with the width of an image region to be charged, the shape, the opening width, and the processing speed (peripheral velocity) of a transfer charger, and the like. To decrease the cost, a monolayer foam roller or the like is suitably used as a transfer roller.

Intermediate Transfer Member

As the intermediate transfer member, an existing intermediate transfer member may be used. An example of a material for forming an intermediate transfer member include polycarbonate (PC), polyvinylidene fluoride (PVDF), polyalkylene phthalate, polyimide, polyamide, polyamide-imide, a blended material of PC and polyalkylene terephthalate (PAT), a blended material of an ethylene tetrafluoroethylene copolymer (ETFE) and PC, a blended material of ETFE and PAT, and a blended material of PC and PAT. In view of mechanical strength, an intermediate transfer belt composed of a thermosetting polyimide resin is desirably used.

Cleaning Section

The cleaning section may be appropriately selected from cleaning sections employing a blade cleaning system, a brush cleaning system, a roller cleaning system, and the like as long as the cleaning section cleans off toner remaining on an electrostatic-latent-image holding member. In particular, a cleaning blade is desirably used. An example of a material for forming such a cleaning blade include a polyurethane rubber, a neoprene rubber, and a silicone rubber. In particular, a polyurethane elastic body, which has a high wear resistance, is desirably used.

When a toner having a high transfer efficiency is used, a configuration without a cleaning section may be employed.

Fixing Section

The fixing section (fixing device) fixes a toner image having been transferred onto a recording medium, by, for example, the application of heat, pressure, or heat and pressure. Other than the double-roller system in the exemplary embodiment, there are a belt-roller nip system in which one of the heating part and the pressing part has the shape of a belt and the other has the shape of a roller; a double-belt system in which both the heating part and the pressing part have the shape of a belt; and the like. As for such a belt, a system in which a belt is stretched by plural rollers or a free-belt system in which a belt is used without being stretched may be used. In an exemplary embodiment according to the invention, a fixing device employing such a system may be used.

Recording Medium

As a recording medium (recording paper) on which a toner image is transferred and a complete recording image is formed, for example, plain paper or an OHP sheet used for an electrophotographic copier, a printer, or the like may be used. To further enhance the smoothness of the surface of a fixed image, the surface of a recording medium is desirably smooth as much as possible. For example, coated paper in which a surface of plain paper has been coated with a resin or the like, art paper for printing, or the like is suitably used.

When thick paper having a basis weight of about 80 g/m$^2$ or more and 120 g/m$^2$ or less, which is generally the upper limit of the thickness of paper with which fixing is performed without changing the processing speed of an apparatus, is used as a recording medium under special usage conditions, there is the probability of a decrease in the fixing strength of a low-gloss toner having a high fixing temperature. However, according to an exemplary embodiment of the invention, even when such thick paper is used as a recording medium, the difference in fixing strength between a high-gloss image and a low-gloss image is small. Therefore, in an image forming apparatus according to the exemplary embodiment, use of standard thin paper is obviously possible and, in addition, such thick paper may be suitably used as a recording medium.

First Black Toner and Second Black Toner

The first black toner and the second black toner according to an exemplary embodiment of the invention will be described. As for the color toners that are other than the black toners and are of one type for each color (in the exemplary embodiment, three toners of a yellow toner, a magenta toner, and a cyan toner), descriptions of such color toners are omitted.

In the exemplary embodiment, the first black toner is a high-viscosity toner and a fixed toner image formed of the first black toner has a low glossiness (low gloss). Thus, the first black toner is suitable for forming images of characters, charts, and the like and is used for forming such images. In contrast, the second black toner is a low-viscosity toner and a fixed toner image formed of the second black toner has a high glossiness (high gloss). Thus, the second black toner is suitable for forming photographic images, high-resolution images, and full-color images and is used for forming such images. The first black toner corresponds to the toner A of the invention and the second black toner corresponds to the toner B of the invention.

The first black toner and the second black toner obviously have similar colors. Although toners having similar black colors are used in the exemplary embodiment, the invention is not restricted to the exemplary embodiment and toners having similar colors of another hue may be used.

Herein, "similar colors" are colors generally classified as having the same hue. For example, coloring agents classified in the same hue in Colour Index provide similar colors.

The black toner (hereafter, the term "black toner" without "first" or "second" refers to black toner that encompasses both "the first black toner" and "the second black toner") contains a binder resin and a colorant, and, if necessary, a release agent and another component. If necessary, an external additive is further added to the black toner.

As for the black toner, each component of toner particles other than an external additive will be described in detail. Then, a method for producing the toner particles, a toner to which an external additive has been added (hereafter, sometimes simply referred to as "external additive toner"), and physical properties of the toner particles and the external additive toner will be sequentially described.

Binder Resin

The black toner contains, as a binder resin, an amorphous polyester resin and a crystalline polyester resin.

Crystalline Polyester Resin

The crystalline polyester resin used as a binder resin is a polyester resin that is described below and has crystallinity.

In the exemplary embodiment, the term "crystalline" of the "crystalline resin" means that differential scanning calorimetry (DSC) shows that the resin has not a stepwise endothermic change but has a clear endothermic peak in a temperature increase stage and a clear exothermic peak in a temperature decrease stage. Specifically, in the case of performing differential scanning calorimetry (DSC) with a differential scanning calorimeter (apparatus name: DSC-60, manufactured by SHIMADZU CORPORATION) in which the temperature is increased from 0° C. to 150° C. at 10° C./min, the sample is held at 150° C. for 5 minutes, then decreased to 0° C. at −10° C./min, held at 0° C. for 5 minutes, and then increased again to 150° C. at 10° C./min; when, in the spectrum of the second temperature-increase, the temperature from the onset point to the top of the endothermic peak is within 15° C., this endothermic peak is defined as a "clear" endothermic peak. In the temperature decrease, when the sample has a temperature from the onset point to the top of the exothermic peak within 15° C. and has an exotherm of 25 J/g or more, this exothermic peak is defined as a "clear" exothermic peak.

In view of a sharp melting property, the temperature from the onset point to the top of the endothermic peak is preferably within 15° C., more preferably within 10° C. The point of intersection of a tangential line at any point in a flat portion of the baseline of a DSC curve and a tangential line at a point where (the spectrum has the largest inclination) the differential value of the spectrum curve is the maximum in the range of from the baseline to the top of the decrease peak is defined as the "onset point". In the form of a toner, the endothermic peak may have a width of 40° C. or more and 50° C. or less.

When the glass transition temperature of an amorphous polyester resin that will be described in detail below is defined as Tg, the crystalline polyester resin has a melting temperature of (Tg+10)° C. or more and (Tg+30)° C. or less, or about (Tg+10)° C. or more and about (Tg+30)° C. or less. The melting temperature is preferably (Tg+13)° C. or more and (Tg+25)° C. or less.

For the amorphous polyester resin only, as the temperature increases, the elastic modulus of the amorphous polyester resin starts decreasing at the glass transition temperature and has decreased to a fixable elastic modulus at a temperature about 30° C. higher than the glass transition temperature. In the black toner, before the temperature at which the amorphous polyester resin has the fixable elastic modulus is reached, the crystalline polyester resin is brought to its melting temperature. Thus, the toner is molten and low-temperature fixing is achieved.

The specific melting temperature of the crystalline polyester resin is preferably in the range of 50° C. or more and 120° C. or less, or about 50° C. or more and about 120° C. or less, more preferably in the range of 60° C. or more and 90° C. or less. As described below, when a hydrocarbon wax is added to the toner, the melting temperature of the crystalline polyester resin is preferably lower than the melting temperature of the hydrocarbon wax.

As for the molecular weight of the crystalline polyester resin, based on a molecular weight measurement performed by a GPC method using tetrahydrofuran (THF) solubles, the weight average molecular weight (Mw) is preferably in the range of 5,000 or more and 100,000 or less and more preferably in the range of 10,000 or more and 50,000 or less; and the number average molecular weight (Mn) is preferably in the range of 2,000 or more and 30,000 or less and more preferably in the range of 5,000 or more and 15,000 or less. The molecular-weight distribution Mw/Mn is preferably in the range of 1.5 or more and 20 or less and more preferably in the range of 2 or more and 5 or less. When the molecular weight is measured, to enhance the solubility of the crystalline resin in THF, the crystalline resin is preferably heated and molten in a hot-water bath at 70° C.

The crystalline polyester resin desirably has an acid value in the range of 4 mg KOH/g or more and 20 mg KOH/g or less and more desirably in the range of 6 mg KOH/g or more and 15 mg KOH/g or less. The crystalline polyester resin desirably has a hydroxyl value in the range of 3 mg KOH/g or more and 30 mg KOH/g or less and more desirably in the range of 5 mg KOH/g or more and 15 mg KOH/g or less.

In the black toner, the content proportion of the crystalline polyester resin in the binder resin is preferably in the range of 1 mass % or more and 20 mass % or less, more preferably in the range of 1 mass % or more and 10 mass % or less, and still more preferably in the range of 2 mass % or more and 8 mass % or less. When the content of the crystalline resin is too small, there are cases where endotherm by the crystalline resin in fixing is not sufficiently exerted and the effect of using the crystalline resin is small. When the content of the crystalline resin is more than 20 mass %, since the size of the domains of the crystalline resin in the toner are large and the number of the domains are also large, there are cases where the transparency of formed images is low.

The content of the crystalline resin in a binder resin in a toner is calculated in the following manner.

After the toner is held in a drying machine at 50° C. for 72 hours, the toner is dissolved in methyl ethyl ketone (MEK) at room temperature (20° C. or more and 25° C. or less). This is because, when the toner contains the crystalline polyester resin and an amorphous resin, substantially only the amorphous resin is dissolved in MEK at room temperature. Accordingly, the MEK dissolving fraction contains the amorphous resin. Thus, when the MEK solution in which the toner has been dissolved is subjected to centrifugal separation, the resultant supernatant fluid provides the amorphous resin. The solid matter obtained by the centrifugal separation is heated at 65° C. for 60 minutes and dissolved in MEK and filtrated at 60° C. through a filter. The filtrate provides the crystalline polyester resin. During the filtration, a decrease in the temperature causes the crystalline resin to precipitate. Accordingly, to suppress a decrease in the temperature, the filtration is quickly performed while the temperature of the solution is maintained. By measuring the amount of the thus-obtained crystalline polyester resin, the content of the crystalline polyester resin is determined.

Amorphous Polyester Resin

The amorphous polyester resin used as a binder resin is a polyester resin including, as a constitutional unit, a copolymer unit having an alkyl side chain. Such an amorphous polyester resin has a high compatibility with a crystalline polyester resin. Thus, a low-temperature fixing property is enhanced and lowering of a blocking property caused by the separating of the crystalline resin is suppressed.

The number of carbon atoms of the alkyl side chain is preferably 5 or more and more preferably 8 or more. When the number of the carbon atoms is less than 5, the compatibility with the crystalline resin is lowered and there is probability that the fixing property is poor. The upper limit of the number of carbon atoms of the alkyl side chain is not particularly limited; however, the number of the carbon atoms is preferably 20 or less and more preferably 16 or less. When the number of carbon atoms is too large, there is probability that the reactivity of the amorphous polyester resin in the polymerization is poor and it is difficult to prepare a polymer having a target molecular weight.

Examples of a monomer (precursor of a copolymer unit) that is capable of forming a copolymer unit having an alkyl side chain contain isomers of linear diols such as 1,2-octanediol, 1,2-decanediol, 1,2-dodecanediol, 1,2-tetradecanediol, and 1,2-hexadecanediol; and succinic acid derivatives such as decenyl succinic acid, dodecenyl succinic acid, tetradecenyl succinic acid, and hexadecenyl succinic acid. Of these, dodecenyl succinic acid is preferred in view of the glass transition temperature of the resin and the compatibility of the resin with the crystalline resin.

When the amorphous polyester resin is formed from dodecenyl succinic acid using as a monomer, a copolymer unit having an alkyl side chain has a dodecenyl succinic acid structure.

Herein, the term "dodecenyl succinic acid structure" is a constitutional unit in which hydrogen atoms have been removed from the two carboxylic groups of dodecenyl succinic acid and is represented by the following structural formula.

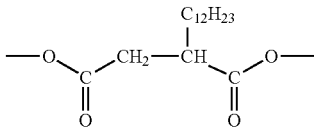

The functional group represented by $C_{12}H_{23}$ is a dodecenyl group, which includes one carbon-carbon double bond in a linear structure of 12 carbon atoms. The position of the double bond in the linear structure is not limited and may be any position in the linear structure.

The dodecenyl succinic acid structure is present as a copolymer unit in the state of being bonded into the structure of a polyester resin described below. The copolymerization proportion of the dodecenyl succinic acid structure with respect to a constitutional unit derived from alcohol in the polyester resin is preferably in the range of 3 mol % to 30 mol %, more preferably in the range of 5 mol % to 25 mol %, and still more preferably in the range of 7 mol % to 20 mol %. When the content of the dodecenyl succinic acid structure is too small, the dispersibility of a coloring agent is lowering, which is not desirable. When the content of the dodecenyl succinic acid structure is too large, a brown-tinted resin is obtained, which is not preferable. When a "copolymer unit including an alkyl side chain" other than the dodecenyl succinic acid structure is used, the preferred copolymerization contents are applied.

The dodecenyl succinic acid structure may be bonded into the structure of a polyester resin by copolymerizing the synthesis materials of the polyester resin together with dodecenyl succinic acid or dodecenyl succinic acid anhydride in the synthesis of the polyester resin. When a structural unit other than the dodecenyl succinic acid structure is used as a copolymer unit, a monomer corresponding to the structural unit may be appropriately used and bonded into the structure of a polyester resin in the same manner as in the above-described case of the dodecenyl succinic acid structure.

As for the term "amorphous" in the amorphous polyester resin, the amorphous polyester resin is a resin that does not satisfy the above crystalline resin description. Specifically, in the case of performing differential scanning calorimetry (DSC) with a differential scanning calorimeter (apparatus name: DSC-60, manufactured by SHIMADZU CORPORATION), when the temperature from the onset point to the top of the endothermic peak is beyond 15° C. in the temperature increase at 10° C./min, a clear endothermic peak is not observed, or a clear exothermic peak is not observed in the temperature decrease, the resin is defined as "amorphous". The "onset point" of a DSC curve is determined in the same manner as in the above-described "crystalline resin".

The glass transition temperature of the amorphous polyester resin is preferably in the range of 45° C. or more and 70° C. or less or about 45° C. or more and about 70° C. or less, and more preferably in the range of 50° C. or more and 65° C. or less. When the glass transition temperature is too low, the storability of the toner tends to be lowering. When the glass transition temperature is too high, the fixing property of the toner tends to be poor.

As for the molecular weight of the amorphous polyester resin, based on a molecular weight measurement performed by a GPC method using tetrahydrofuran (THF) solubles, the weight average molecular weight (Mw) is desirably in the range of 15,000 or more and 250,000 or less and more desirably in the range of 20,000 or more and 150,000 or less; and the number average molecular weight (Mn) is desirably in the range of 3,000 or more and 30,000 or less and more desirably in the range of 5,000 or more and 10,000 or less.

In the black toner, the content of the amorphous polyester resin in the binder resin is preferably 60 mass % or more or about 60 mass % or more, and more preferably 80 mass % or more. When the content of the amorphous polyester resin is too small, there is a possibility that properties of the amorphous polyester resin do not sufficiently appear. It is desired that the entirety of an amorphous resin be the amorphous polyester resin.

Polyester Resin

A polyester resin is polycondensed from a dihydric acid (dicarboxylic acid) and a dihydric alcohol (diol). In the case of a copolymer in which the main chain of a polyester resin has been bonded to another component (containing a precursor of a copolymer unit having an alkyl side chain) by copolycondensation, when the content of the other component is 20 mass % or less, this copolymer is referred to as a polyester resin.

In the polyester resin, examples of an acid component include various dicarboxylic acids. These acid components may be used singly or in a mixture of two or more thereof. Such a dicarboxylic acid may be having a sulfonic group in order to enhance emulsification properties in an emulsion-aggregation method.

The term "acid-derived constitutional unit" denotes a structural portion that was an acid component before the synthesis of a polyester resin. A term "alcohol-derived constitutional unit" described below denotes a structural portion that was an alcohol component before the synthesis of a polyester resin.

In the production of a crystalline polyester resin, it is preferable to use an aliphatic dicarboxylic acid as the dicarboxylic acid and, in particular, a linear carboxylic acid is more preferable. Examples of such a linear dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,18-octadecanedicarboxylic acid, 1,20-eicosanedicarboxylic acid, lower alkyl esters thereof, and anhydrides thereof. Of these, the linear dicarboxylic acids including 6 or more and 10 or less carbon atoms are preferred.

In the case of the crystalline polyester resin, to obtain the high crystallinity polyester, the amount of the linear dicarboxylic acid is 95 mol % or more of the acid-derived constitutional units, and more preferably 98 mol % or more. The "mol %" is percentage in which each constitutional unit (acid-derived constitutional unit and alcohol-derived constitutional unit) in a polyester resin is defined as one unit (mole).

The acid-derived constitutional unit may include, in addition to constitutional units derived from the above-described aliphatic dicarboxylic acids, constitutional components such as constitutional units derived from dicarboxylic acids having sulfonic groups.

For the production of the amorphous polyester resin, the dicarboxylic acid include terephthalic acid, fumaric acid, and trimellitic acid are preferable as a dicarboxylic acid.

In the crystalline polyester resin, an alcohol that is to serve as the alcohol-derived constitutional unit is desirably an aliphatic diol. Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol. Of these, diols having 2 or more and 10 or less carbon atoms are preferred. In the case of the crystalline polyester resin, to obtain the high crystallinity polyester, the amount of the linear dialcohol is 95 mol % or more of the alcohol-derived constitutional units, and more preferably 98 mol % or more.

Examples of other divalent alcohols include bisphenol A, hydrogenated bisphenol A, ethylene oxide and/or propylene oxide adducts of bisphenol, 1,4-cyclohexanediol, 1,4-cyclohexanedimethanol, diethylene glycol, propylene glycol, dipropylene glycol, 1,3-butanediol, and neopentyl glycol. These dialcohols may be used alone or in combination of two or more thereof.

In the production of an amorphous polyester resin, a suitable example of an alcohol that is to serve as the alcohol-derived constitutional unit include an ethylene oxide adduct of bisphenol and a propylene oxide adduct of bisphenol.

If necessary, for example, for the purpose of adjusting the acid value or the hydroxyl value, one or more of the following compounds may be further used: monovalent acids such as acetic acid and benzoic acid; monovalent alcohols such as cyclohexanol and benzyl alcohol; benzenetricarboxylic acid, naphthalenetricarboxylic acid, acid anhydrides of the thereof, and lower alkyl esters of the thereof; and trivalent alcohols such as glycerin, trimethylolethane, trimethylolpropane, and pentaerythritol.

Another monomer (excluding a monomer of a precursor of a copolymer unit having an alkyl side chain) is not particularly limited. For example, an existing divalent carboxylic acid or a divalent alcohol may be used. Specific examples of such a monomer component of a divalent carboxylic acid include diacid such as phthalic acid, isophthalic acid, terephthalic acid, naphthalene-2,6-dicarboxylic acid, naphthalene-2,7-dicarboxylic acid, and cyclohexane dicarboxylic acid; acid anhydrides of the thereof; and lower alkyl esters of the thereof. These monomer components may be used alone or in combination of two or more thereof.

The polyester resin may be synthesized from a desired combination of the above-described monomer components, in the case of the amorphous polyester resin, in the presence of a monomer of a precursor of a copolymer unit having an alkyl side chain, by an existing method. A transesterification method, a direct polycondensation method, and the like may be employed alone or in combination.

Specifically, the synthesis may be performed at a polymerization temperature of 140° C. or more and 270° C. or less. If necessary, the pressure within the reaction system is reduced and the reaction is made to proceed while water or alcohol generated by the condensation is removed. When a monomer does not dissolve or compatibly dissolve at a reaction temperature, it may add a solvent having a high boiling point as a dissolution auxiliary solvent to dissolve the monomer. A polycondensation reaction is performed while the dissolution auxiliary solvent is evaporated. When a monomer having a poor compatibility is present in a copolymerization reaction, condensation between the monomer having a poor compatibility and an acid or an alcohol that is to be subjected to polycondensation with the monomer is performed and then polycondensation between the condensed product and a main component is performed.

The molar ratio (acid component/alcohol component) in the reaction between the acid component and the alcohol component varies in accordance with reaction conditions or the like and is not generally determined. However, in the case of direct polycondensation, the molar ratio is generally 0.9/1.0 to 1.0/0.9. In the case of transesterification reaction, a monomer that is evaporated in a vacuum such as ethylene glycol, propylene glycol, neopentyl glycol, or cyclohexanedimethanol may be excessively used.

Examples of a catalyst usable in the production of a polyester resin include: titanium aliphatic carboxylates such as titanium aliphatic monocarboxylates (e.g. titanium acetate, titanium propionate, titanium hexanoate, and titanium octanoate), titanium aliphatic dicarboxylates (e.g. titanium oxalate, titanium succinate, titanium maleate, titanium adipate, and titanium sebacate), titanium aliphatic tricarboxylates (e.g. titanium hexanetricarboxylate and titanium isooctanetricarboxylate), and titanium aliphatic polycarboxylates (e.g. titanium octanetetracarboxylate and titanium decanetetracarboxylate); titanium aromatic carboxylates such as titanium aromatic monocarboxylates (e.g. titanium benzoate), titanium aromatic dicarboxylates (e.g. titanium phthalate, titanium terephthalate, titanium isophthalate, titanium naphthalenedicarboxylate, titanium biphenyldicarboxylate, and titanium anthracenedicarboxylate), titanium aromatic tricarboxylates (e.g. titanium trimellitate and titanium naphthalenetricarboxylate), and titanium aromatic tetracarboxylates (e.g. titanium benzenetetracarboxylate and titanium naphthalenetetracarboxylate); titanyl compounds of titanium aliphatic carboxylates and titanium aromatic carboxylates and alkali metal salts of such titanyl compounds; titanium halides such as titanium dichloride, titanium trichloride, titanium tetrachloride, and titanium tetrabromide; tetraalkoxy titaniums such as tetrabutoxy titanium (titanium tetrabutoxide), tetraoctoxy titanium, and tetrastearyloxy titanium; and titanium-containing catalysts such as titanium acetylacetonate, titanium diisopropoxide bisacetylacetonate, and titanium triethanolaminato.

As a catalyst suitable for the production of a crystalline polyester resin, a titanium-containing catalyst and/or an inorganic tin catalyst is desirably used in combination with another auxiliary catalyst. When such a mixture of catalysts is used, the proportion of a titanium-containing catalyst and/or an inorganic tin catalyst with respect to the entire catalysts is desirably 70 mass % or more; more desirably, the mixture is entirely composed of a titanium-containing catalyst and/or an inorganic tin catalyst; and still more desirably, the mixture is entirely composed of a titanium-containing catalyst.

In polymerization, the catalyst is desirably added in the range of 0.02 parts by mass or more and 1.0 part by mass or less with respect to 100 parts by mass of the monomer component (in the case of the amorphous polyester resin, a monomer that is a precursor of a copolymer unit including an alkyl side chain is excluded).

Other Resins

The binder resin desirably contains the above-described polyester resins only, and another resin may also be used in combination. Examples of a usable resin other than polyester resins include amorphous resins, for example, homopolymers and copolymers of monoolefins such as ethylene, propylene, butylene, and isoprene; vinyl esters such as vinyl acetate, vinyl propionate, vinyl benzoate, and vinyl butyrate; α-methylene aliphatic monocarboxylic acid esters such as methyl acrylate, phenyl acrylate, octyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. In particular, representative examples of such binder resins include polystyrene, styrene-alkyl acrylate copolymers, styrene-butadiene copolymers, styrene-maleic anhydride copolymers, and polypropylene. Furthermore, examples of such binder resins include polyurethane resins, epoxy resins, silicone resins, polyamide resins, and modified rosins.

A crystalline resin other than crystalline polyester resins may also be contained as a binder resin. Specific examples of such a crystalline resin include crystalline vinyl resins.

Examples of the crystalline vinyl resins include vinyl resins derived from long-chain alkyl/alkenyl(meth)acrylates such as amyl(meth)acrylate, hexyl(meth)acrylate, heptyl (meth)acrylate, octyl(meth)acrylate, nonyl(meth)acrylate, decyl(meth)acrylate, undecyl(meth)acrylate, tridecyl(meth) acrylate, myristyl(meth)acrylate, cetyl(meth)acrylate, stearyl (meth)acrylate, oleyl(meth)acrylate, and behenyl(meth)acrylate. In the present specification, the term "(meth)acrylate" encompasses "acrylate" and "methacrylate"; and the term "(meth)acrylic" encompasses "acrylic" and "methacrylic".

Coloring Agent

In the black toner, a black pigment or a black dye is used as a coloring agent. As long as a coloring agent is black, it may be used without particular limitation. Specific examples of a coloring agent include carbon black, aniline black, perylene, nigrosine, and sepia. Of these, carbon black is most suitable in view of ease of available, low cost, and relatively high degree of black color.

Among carbon blacks, furnace black is preferred because furnace black is suitable for mass production and the oil absorption, the particle size, and the structure of furnace black are readily controlled. Specific examples of carbon blacks include #5, #10, and #25 (manufactured by Mitsubishi Chemical Corporation), TOKABLACK #7400, #7550SB/F, and #7360SB (manufactured by TOKAI CARBON CO., LTD.), and NIPex 35, 60, 70, 90, and 170 IQ (manufactured by Evonik Degussa Japan Co., Ltd.). However, these carbon blacks are mere examples and the invention is not limited to these examples.

In the exemplary embodiment, black toners are used as examples of "a toner A and a toner B that have similar colors" in the invention. Similarly, in the case of using another color, existing coloring agents may be used. Specific examples of such coloring agents include various pigments such as chrome yellow, Hansa yellow, benzidine yellow, thren yellow, quinoline yellow, permanent yellow, permanent orange GTR, pyrazolone orange, vulcan orange, Watchung Red, permanent red, brilliant carmin 3B, brilliant carmin 6B, Dupont oil red, pyrazolone red, lithol red, rhodamine B lake, lake red C, rose bengal, aniline blue, ultramarine blue, calco oil blue, methylene blue chloride, phthalocyanine blue, phthalocyanine green, and malachite green oxalate; and various dyes such as acridine dyes, xanthene dyes, azo dyes, benzoquinone dyes, azine dyes, anthraquinone dyes, dioxazine dyes, thiazine dyes, azomethine dyes, indigo dyes, thioindigo dyes, phthalocyanine dyes, triphenylmethane dyes, diphenylmethane dyes, thiazine dyes, thiazole dyes, and xanthene dyes. These coloring agents may be used alone or in combination of two or more thereof.

A coloring agent particle dispersion used in the production of toner mother particles by an emulsion-aggregation method described below is desirably prepared by dispersing such a coloring agent in water together with a polyelectrolyte such as an ionic surfactant, a polymer acid, or a polymer base. The coloring agent may be dispersed by an conventional dispersion method, for example, by using a general dispersion apparatus such as a rotary shearing homogenizer; a media-containing dispersion system such as a ball mill, a sand mill, or a dyno mill; or an Ultimaizer. Thus, no limitation is imposed on a method for dispersing the coloring agent.

The volume average particle size of coloring agent particles being dispersed in a coloring agent particle dispersion is preferably 1 μm or less, and more preferably in the range of 50 to 250 nm because coloring agent particles satisfying this range have good aggregation properties and are sufficiently dispersed in toner mother particles.

The content of the coloring agent in the toner mother particles is desirably in the range of 1 to 30 parts by mass with respect to 100 parts by mass of the binder resin. If necessary, coloring agent particles that have been surface treated or a pigment dispersing agent may be effectively used.

Release Agent

The black toner desirably contains a release agent. Such a release agent desirably has a main maximum endothermic peak in the range of 60° C. or more and 120° C. or less in a DSC curve measured in accordance with ASTMD3418-8 and has a melt viscosity of 1 mPas or more and 50 mPas or less at 140° C.

The release agent preferably has an endotherm onset temperature of 40° C. or more in a DSC curve measured with a differential scanning calorimetry, more preferably 50° C. or more. The endotherm onset temperature varies in accordance with low-molecular-weight molecules of the wax (release agent) and the type and the amount of a polar group of the wax.

In general, as the molecular weight is increased, the melting temperature and the endotherm onset temperature are increased. However, when such a method is employed, it is too difficult to obtain the properties of low melting temperature and low viscosity. Accordingly, it is effective to selectively remove low-molecular-weight molecules in the molecular-weight distribution of wax. This is performed by, for example, molecular distillation, solvent separation, or gas chromatographic separation.

The DSC measurement may be performed in the above-described manner.

The melt viscosity of the release agent is measured with an E-type viscometer. In this measurement, an E-type viscometer (manufactured by TOKYO KEIKI INC.) equipped with an oil-circulation constant temperature bath is used. In the measurement, a plate having a combination of a cone plate having a cone angle of 1.34° and a cup is used. A sample is put into a cup and the temperature of the circulation device is set at 140° C. An empty measurement cup and a cone are set in the measurement apparatus and are maintained at a constant temperature while the oil is circulated. After the temperature is stabilized, 1 g of a sample is put into the measurement cup and the cone is left at rest for 10 minutes. After stabilization is achieved, the cone is rotated and the measurement is started. The cone is rotated at 60 rpm. The measurement is conducted three times and the average of the obtained values is defined as melt viscosity $\eta$.

The examples of the release agent include hydrocarbon waxes such as polyethylene wax, polypropylene wax, polybutene wax, and paraffin wax; silicones that are softened by heating; fatty amides such as oleic acid amide, erucic acid amide, ricinoleic acid amide, and stearic acid amide; plant waxes such as carnauba wax, rice wax, candelilla wax, Japan wax, and jojoba oil; animal waxes such as beeswax; ester waxes such as fatty esters and montanic acid esters; mineral and petroleum waxes such as montan wax, ozokerite, ceresin, microcrystalline wax, and Fischer-Tropsch wax; and modified waxes of the thereof.

In the exemplary embodiment, a hydrocarbon wax having a melting temperature of 60° C. or more and less than 100° C. is desirably used. When such a hydrocarbon wax is used, the compatibility between the crystalline polyester resin of the binder resin and a coloring agent is higher and the aggregation of the coloring agent is further suppressed. In this case, when the hydrocarbon wax has a higher melting temperature than the crystalline polyester resin, in fixing, the crystalline polyester resin is molten earlier than the hydrocarbon wax and the crystalline polyester resin and an amorphous polyester resin dissolve in each other. Thus, when the solubility parameter has decreased, the hydrocarbon wax is molten. Accordingly, the formation of domains of the hydrocarbon wax is suppressed and the formation of domains of the coloring agent is also suppressed. As a result, color forming properties are further improved.

The amount of the release agent added is preferably 1 part by mass or more and 15 parts by mass or less, more preferably 3 parts by mass or more and 10 parts by mass or less, with respect to 100 parts by mass of the binder resin. When the amount of the release agent added is too small, there are cases where the effect of adding the release agent is low. When the amount of the release agent added is too large, there are cases where the flowability is extremely degraded and the charging distribution becomes extremely broad.

Other Components

If necessary, inorganic or organic particles may be added to the black toner.

As for inorganic particles that may be added, for example, there are silica, hydrophobic silica, alumina, titanium oxide, calcium carbonate, magnesium carbonate, tricalcium phosphate, colloidal silica, colloidal silica treated with alumina, colloidal silica treated with cations, and colloidal silica treated with anions. These particles may be used alone or in combination. In particular, colloidal silica is desirably used. Colloidal silica desirably has a particle size of 5 nm or more and 100 nm or less. Particles having different sizes may be used in combination. Although such particles may be directly added in the production of a toner, use of such particles having been dispersed in an aqueous medium such as water by using an ultrasonic dispersion apparatus or the like is desirable. In this dispersion, the dispersibility of the particles may be enhanced with an ionic surfactant, a polymer acid, a polymer base, or the like.

In addition, a conventional material such as a charge control agent may be added to the black toner. In this case, such a material added preferably has a number average particle size of 1 μm or less, and more preferably 0.01 μm or more and 1 μm or less. Such a number average particle size may be measured with a Microtrac or the like.

Production of Toner Particles

As for a method for producing the black toner, a generally used method such as a kneading-pulverizing method or a wet granulation method may be used. In particular, in view of encapsulating a crystalline resin within a toner, a wet granulation method is preferably used. A desirable wet granulation method is an existing method such as a melting-suspension method, an emulsion-aggregation method, or a dissolution-suspension method. Hereinafter, an emulsion-aggregation method will be described as an example.

An emulsion-aggregation method is a production method including a step (aggregation step) of preparing an aggregation particle dispersion by forming aggregation particles in a dispersion (hereafter, sometimes referred to as "emulsion solution") in which resin particles have been dispersed; and a step (coalescence step) of coalescing the aggregation particles by heating the aggregation particle dispersion. In addition, a step (dispersion step) of dispersing the particles may be performed before the aggregation step. A step (adhesion step) of forming adhesion particles in which particles are made to adhere to the aggregation particles by mixing a particle dispersion in which the particles have been dispersed with the aggregation particle dispersion may be performed between the aggregation step and the coalescence step. In the adhesion step, the particle dispersion is added to and mixed with the aggregation particle dispersion having been prepared in the aggregation step to make the particles adhere to the aggregation particles to thereby form adhesion particles. Since the added particles are newly added particles with respect to the aggregation particles, the added particles are sometimes referred to as "additional particles".

The additional particles may be the resin particles and one or more selected from release agent particles, coloring agent particles, and the like. The way of adding the particle dispersion is not particularly limited. For example, the particle dispersion may be continuously and slowly added or may be added plural times in a stepwise manner. By performing the adhesion step, a quasi shell structure may be formed.

In the toner, by proceeding the addition of the additional particles, a core-shell structure is desirably formed. A binder resin of the additional particles forms a resin of the shell layers. In this way, the shape of toner particles may be readily controlled in the coalescence step by adjusting temperature, the number of stirring, pH, or the like.

In the emulsion-aggregation method, a crystalline polyester resin, an amorphous polyester resin, and, if necessary, another resin are used. The emulsion-aggregation method desirably includes an emulsification step of forming emulsion particles (droplets) by separately or collectively emulsifying a crystalline polyester resin, an amorphous polyester resin, and additional resin (if necessary).

In the emulsification step, the emulsion particles (droplets) of the resins are formed by applying a shearing force to a mixture solution in which an aqueous medium and a mixed solution (resin solution) containing one of the resins and a coloring agent (if necessary) have been mixed together. At this time, by heating the mixture solution to a temperature equal to or higher than the glass transition temperature of the amorphous polyester resin, a temperature equal to or higher than the melting temperature of the crystalline polyester resin (hereafter, the glass transition temperature and the melting temperature are collectively referred to as a "softening temperature"), or a temperature equal to or higher than the softening temperature of the additional resin, the viscosity of the polymer solution is decreased to thereby form emulsion particles. In addition, a dispersing agent may be used. Hereafter, the resultant dispersions of emulsion particles are referred to as an "amorphous polyester resin particle dispersion", a "crystalline polyester resin particle dispersion", and an "additional resin dispersion", or are sometimes collectively referred to as a "resin dispersion".

An emulsifying apparatus used for forming the emulsion particles is, for example, a homogenizer, a homomixer, a pressure kneader, an extruder, or a media dispersion apparatus. The emulsion particles (droplets) of the polyester resin desirably have an average particle size (volume average particle size) of 0.010 μm or more and 0.5 μm or less, and more desirably 0.05 μm or more and 0.3 μm or less. The volume average particle size of the resin particles is measured with a Doppler scattering particle size distribution analyzer (Microtrac UPA9340, manufactured by NIKKISO CO., LTD.).

When a resin being emulsified has a high melt viscosity, the size of the resin particles is not decreased to a desired particle size. Accordingly, by emulsifying a resin while the temperature is increased with an emulsification apparatus that is capable of performing pressurization at atmospheric pressure or higher and the viscosity of the resin is decreased, an amorphous polyester resin particle dispersion having a desired particle size is provided.

In the emulsification step, a solvent may be added to the resins in advance for the purpose of decreasing the viscosity of the resins. Such a solvent is not particularly limited as long as the solvent is capable of dissolving the polyester resins therein. Examples of the solvent include tetrahydrofuran (THF); methyl acetate; ethyl acetate; ketone solvents such as methyl ethyl ketone; and benzene solvents such as benzene, toluene, and xylene. In particular, an ester solvent such as ethyl acetate or a ketone solvent such as methyl ethyl ketone is preferably used.

An alcohol solvent such as ethanol or isopropyl alcohol may be added to water or directly to the resins. A salt such as sodium chloride or potassium chloride, ammonia, or the like may be added. Of these, ammonia is preferably used.

Furthermore, a dispersing agent may be added. Examples of such a dispersing agent include water-soluble polymers such as polyvinyl alcohol, methylcellulose, carboxymethyl cellulose, and sodium polyacrylate; surfactants such as anionic surfactants (e.g. sodium dodecylbenzenesulfonate, sodium octadecylsulfate, sodium oleate, sodium laurate, and potassium stearate), cationic surfactants (e.g. laurylamine acetate and lauryltrimethylammonium chloride), amphoteric surfactants (e.g. lauryldimethylamine oxide), and nonionic surfactants (e.g. polyoxyethylene alkyl ether, polyoxyethylene alkyl phenyl ether, and polyoxyethylene alkyl amine); and inorganic compounds such as tricalcium phosphate, aluminum hydroxide, calcium sulfate, calcium carbonate, and barium carbonate. Of these, anionic surfactants are suitably used.

The amount of such a dispersing agent used is desirably 0.01 parts by mass or more and 20 parts by mass or less with respect to 100 parts by mass of the binder resin. However, since dispersing agents tend to affect charging properties, when sufficiently high emulsification properties are ensured in view of the hydrophilicity of the main chain of a polyester resin, the acid value or hydroxyl value at the ends of the main chain of a polyester resin, or the like, it is desired that no dispersing agent be added, if possible.

In the emulsification step, a dicarboxylic acid including a sulfonic group may be introduced into the amorphous and/or crystalline polyester resin by copolymerization (specifically, a suitable amount of a constitutional unit derived from a dicarboxylic acid including a sulfonic group is included in the acid-derived constitutional units). The amount of the dicarboxylic acid added is desirably 10 mol % or less with respect to the acid-derived constitutional units. However, when sufficiently high emulsification properties are ensured in view of the hydrophilicity of the main chain of a polyester resin, the acid value or hydroxyl value at the ends of the main chain of a polyester resin, or the like, it is desired that no dicarboxylic acid be added, if possible.

The formation of the emulsion particles may be performed by a phase inversion emulsification method. The phase inversion emulsification method is performed by dissolving a resin in a solvent to provide a resin-dissolved solution; if necessary, adding a neutralizing agent or a dispersion stabilizing agent to the resin-dissolved solution; dropping an aqueous medium into the resin-dissolved solution that is being stirred to provide emulsion particles; then removing the solvent from this resin dispersion to thereby provide an emulsion. In the method, the order of adding the neutralizing agent and the dispersion stabilizing agent may be changed.

Examples of the solvent in which the resin is dissolved include heterocyclic substitution compounds derived from toluene, xylene, benzene, and the like; and carbon halides such as carbon tetrachloride, methylene chloride, 1,2-dichloroethane, 1,1,2-trichloroethane, trichloroethylene, chloroform, monochlorobenzene, and dichloroethylidene. These solvents may be used alone or in combination of two or more thereof. In general, acetates, methyl ketones, and ethers that are low-boiling-point solvents are preferably used. In particular, acetone, methyl ethyl ketone, acetic acid, ethyl acetate, and butyl acetate are preferred. Solvents having relatively high volatility are desirably used so that the solvents do not remain in resin particles. The amount of such a solvent used is preferably 20 mass % or more and 200 mass % or less with respect to the amount of the resin, and more preferably 30 mass % or more and 100 mass % or less.

As the aqueous medium, although ion-exchanged water is basically used, the aqueous medium may contain a water-soluble solvent as long as the water-soluble solvent does not break oil droplets. Examples of the water-soluble solvent include alcohols having a short carbon chain such as methanol, ethanol, 1-propanol, 2-propanol, 1-butanol, 2-butanol, t-butanol, and 1-pentanol; ethylene glycol monoalkyl ethers such as ethylene glycol monomethyl ether, ethylene glycol monoethyl ether, and ethylene glycol monobutyl ether; ethers; diols; THF; and acetone. Of these, ethanol and 2-propanol are preferably used.

The amount of such a water-soluble solvent used is preferably 0 mass % or more and 100 mass % or less with respect to the amount of the resin, and more preferably 5 mass % or more and 60 mass % or less. Such a water-soluble solvent may be mixed with ion-exchanged water added and, in addition, may be added to the resin-dissolved solution.

If necessary, a dispersing agent may be added to a resin solution and an aqueous component. Such a dispersing agent forms a hydrophilic colloid in an aqueous component. Examples of the dispersing agent include cellulose derivatives such as hydroxymethyl cellulose, hydroxyethyl cellulose, and hydroxypropyl cellulose; synthetic polymers such as polyvinyl alcohol, polyvinyl pyrrolidone, polyacrylamide, polyacrylate, and polymethacrylates and dispersion stabilizing agents such as gelatin, gum arabic, and agar.

A solid particles of silica, titanium oxide, alumina, tricalcium phosphate, calcium carbonate, calcium sulfate, barium carbonate, or the like may be used. In the exemplary embodiment, since a toner contains an aluminum component, it is desirable that an appropriate amount of alumina be used as a dispersing agent and the alumina be remained in the final toner. To control the amount of aluminum remaining, shortage of aluminum may be filled with another dispersing agent. In a way of controlling the amount of aluminum remaining, it may be possible that alumina is not used. Such a dispersion stabilizing agent is generally added such that the concentration of the dispersion stabilizing agent in an aqueous component is 0 mass % or more and 20 mass % or less, and desirably 0 mass % or more and 10 mass % or less.

As the dispersing agent, a surfactant may be used. As the surfactant, for example, a surfactant that is used in a coloring agent dispersion described below may be used. Examples of the surfactant include natural surfactant components such as saponin; cationic surfactants such as alkylamine hydrochlorides and alkylamine acetates, quaternary ammonium salts, and glycerins; and anionic surfactants such as fatty acid soaps, sulfates, alkylnaphthalene sulfonates, sulfonates, phosphoric acid, phosphates, and sulfosuccinates. Anionic surfactants and nonionic surfactants are preferably used. To adjust the pH of the emulsion, a neutralizing agent may be added. Examples of the neutralizing agent include common acids and common alkalis such as nitric acid, hydrochloric acid, sodium hydroxide, and ammonia.

As a method of removing a solvent from the emulsion, a method of evaporating the solvent from the emulsion in the temperature range of 15° C. or more and 70° C. or less may be desirably performed or this method may be desirably performed under a reduced pressure.

In the exemplary embodiment, in view of particle size distribution or particle size controllability, it is desirable that, after emulsification is performed by a phase inversion emulsification method, a method of removing a solvent by heating under a reduced pressure be used. When the emulsion is used for a toner, in view of influences on charging properties, it is desirable that use of a dispersing agent or a surfactant be minimized and the emulsification properties be controlled with hydrophilicity of the main chain of a polyester resin, the acid value or hydroxyl value at the ends of the main chain of a polyester resin, or the like.

The coloring agent or the release agent may be dispersed by a common dispersion method, for example, by using a high-pressure homogenizer, a rotary shearing homogenizer, an ultrasonic dispersion apparatus, a high-pressure impact dispersion apparatus, or a media-containing dispersion system such as a ball mill, a sand mill, or a dyno mill. Thus, no limitation is imposed on a method for dispersing the coloring agent or the release agent.

If necessary, an aqueous dispersion of the coloring agent may be prepared with a surfactant or an organic solvent dispersion of the coloring agent may be prepared with a dispersing agent. Hereafter, such a dispersion of the coloring agent is sometimes referred to as a "coloring agent dispersion"; and a dispersion of the release agent is sometimes referred to as a "release agent dispersion".

A dispersing agent used for the coloring agent dispersion or the release agent dispersion is a surfactant. Suitable examples of the surfactant include anionic surfactants such as sulfates, sulfonates, phosphates, and soaps; cationic surfactants such as amine salts and quaternary ammonium salts; and nonionic surfactants such as polyethylene glycols, alkylphenol ethyleneoxide adducts, and polyhydric alcohols. Of these, the ionic surfactants are preferable and the anionic surfactants and the cationic surfactants are more preferable. Such a nonionic surfactant may be used in combination with such an anionic surfactant or cationic surfactant. A surfactant used desirably has the same polarity as that of a dispersing agent used for another dispersion such as a release agent dispersion.

The amount of the dispersing agent used is preferably 2 mass % or more and 10 mass % or less with respect to the coloring agent or the release agent, and more preferably 5 mass % or more and 30 mass % or less.

An aqueous dispersion medium used is desirably a medium containing low amounts of impurities such as metal ions, for example, distilled water, ion-exchanged water, or the like. Alcohol or the like may be further added to the aqueous dispersion medium. Polyvinyl alcohol, a cellulose polymer, or the like may be added to the aqueous dispersion medium. However, to avoid remaining of such components in a toner, it is desirable that no such components be used, if possible.

An apparatus for preparing a dispersion of the various additives is not particularly limited. For example, there are usual dispersion apparatuses such as a rotary shearing homogenizer, media-containing dispersion systems (e.g. a ball mill, a sand mill, and a dyno mill), apparatuses similar to those used for preparing the coloring agent dispersion or the release agent dispersion, and the like. An optimal apparatus may be selected from these apparatuses.

In the aggregation step, to form aggregation particles, an aggregating agent is desirably used. Examples of the aggregating agent used include a surfactant having a polarity opposite to that of a surfactant used for the dispersing agent, general inorganic metal compounds (inorganic metal salts), and polymers of inorganic metal salts. The metal elements that constitute the inorganic metal salts belong to 2A, 3A, 4A, 5A, 6A, 7A, 8, 1B, 2B, and 3B groups in a periodic table (long-form periodic table), have a charge of divalent or more, and dissolve in the form of an ion in the aggregation system of resin particles.

The examples of usable inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide. Of these, in particular, aluminum salts and polymers of aluminum salts are preferred. In general, to provide a sharper particle size distribution, a divalent inorganic metal salt is more suitable than a monovalent inorganic metal salt; an inorganic metal salt that is trivalent or more is more suitable than a divalent inorganic metal salt; and an inorganic metal salt polymer is more suitable than an inorganic metal salt in terms of the same valency.

In the exemplary embodiment, since the toner contains an aluminum content, it is desirable that an appropriate amount of a compound containing aluminum be used as an aggregating agent and the compound be remained in the toner. However, to control the amount of aluminum remaining, shortage of aluminum may be filled with another aggregating agent. In a way of controlling the amount of aluminum remaining, it may be possible that only an aggregating agent containing no aluminum is used.

The amount of such an aggregating agent added varies in accordance with the type or the valency of the aggregating agent; however, the amount is generally in the range of 0.05 mass % or more and 0.1 mass % or less. Since, for example, such an aggregating agent flows into an aqueous medium or forms coarse particles in the preparation of a toner, not the entire amount of the aggregating agent added remains in the toner. In particular, when the amount of a solvent in a resin is large in the preparation of a toner, the solvent and the aggregating agent interact with each other and the aggregating agent tends to flow into the aqueous medium. Accordingly, the amount of the aggregating agent added is adjusted in accordance with the amount of the solvent remaining.

In the coalescence step, by making the pH of the suspension of aggregate within the range of 5 or more and 10 or less while the suspension is stirred in the same manner as in the aggregation step, the aggregation process is finished; and by heating the suspension to a temperature equal to or higher than the glass transition temperature (Tg) of a resin or a temperature equal to or higher than the melting temperature of a crystalline resin (that is, a softening temperature), the aggregation particles are coalesced. This heating is performed for a period in which desired coalescing is achieved and hence the period may be 0.2 hours or more and 10 hours or less. After the heating, when the temperature of the suspension is decreased to a temperature equal to or lower than the softening temperature of the resin and the particles are solidified, the shape and surface properties of the particles vary in accordance with the temperature decrease rate. This decrease to a temperature equal to or lower than the softening temperature of the resin is preferably performed at a rate of 0.5° C./min or more, and more preferably at a rate of 1.0° C./min or more.

Alternatively, while heating at a temperature equal to or higher than the softening temperature of the resin is performed, particles may be grown under the same conditions of pH and addition of an aggregating agent as in the aggregation step. When a desired particle size is achieved, the temperature may be decreased to a temperature equal to or lower than the softening temperature of the resin at a rate of 0.5° C./min as in the coalescence step to thereby solidify the particles and simultaneously terminate the growth of the particles. In this case in which the aggregation step and the coalescence step are simultaneously performed, the process is simplified, which is desirable. However, there are cases where it is difficult to form the core-shell structure.

After the coalescence step has been finished, the particles are washed and dried to obtain toner particles. The particles are desirably treated by displacement washing with ion-exchanged water. The degree of the washing is generally monitored with the conductivity of filtrate. The final conductivity is desirably made 25 μS/cm or less. In the washing, a step of neutralizing ions with acid or alkali may be performed. In this case, a treatment with acid is desirably performed such that the pH is made 6.0 or less; and a treatment with alkali is desirably performed such that the pH is made 8.0 or more.

The technique of performing the solid-liquid separation after the washing is not particularly limited; however, the solid-liquid separation is desirably performed by, for example, pressure filtration such as suction filtration or filter press in view of productivity. The technique of performing the drying is also not particularly limited; however, the drying is desirably performed by freeze drying, flash jet drying, fluidized drying, vibration fluidized drying, or the like in view of productivity. The drying is preferably performed such that the final moisture percentage of the toner is 1 mass % or less, and more preferably 0.7 mass % or less.

External Additive Toner

The thus-produced toner particles may be mixed with external additives (inorganic particles and organic particles) as a fluidizing agent, a cleaning agent, a polishing agent, and the like.

Examples of inorganic particles that may be externally added include all the particles that are generally used as external additives for the surfaces of toner particles, for example, particles of silica, alumina, titanium oxide, calcium carbonate, magnesium carbonate, tricalcium phosphate, and cerium oxide. The surfaces of such inorganic particles have been desirably made hydrophobic.

Examples of organic particles that may be externally added include all the particles that are generally used as external additives for the surfaces of toner particles, for example, particles of vinyl resins such as styrene polymers, (meth) acrylic polymers, and ethylene polymers; polyester resins; silicone resins; and fluorocarbon resins.

Examples of a hydrophobizing agent that makes inorganic particles that may be externally added hydrophobic include existing materials. For example, the surfaces of inorganic particles may be coated with a coupling agent (e.g. a silane coupling agent, a titanate coupling agent, an aluminate coupling agent, or a zirconium coupling agent), silicone oil, or a polymer.

Such external additives are made to adhere to or be fixed to the surfaces of toner particles by a mechanical impact force provided by a V-type blender, a sample mill, a Henschel mixer, or the like.

Shape of Toner

The particles of the black toner preferably have a spherical shape with a shape factor SF1 in the range of 110 or more and 145 or less. When the particles of the black toner have a spherical shape satisfying this range, the transfer efficiency and the resolution of images are enhanced and high-quality images are formed.

More preferably, the shape factor SF1 is in the range of 110 or more and 140 or less.

The shape factor SF1 is calculated with the following Formula (II).

$$SF1=(ML^2/A)\times(\pi/4)\times 100 \quad \text{(II)}$$

where ML represents the absolute maximum length of toner particles and A represents the projected area of the toner particles.

The shape factor SF1 is determined as described below. A microscopic image or a scanning electron microscope (SEM) image is converted into numbers by analysis using an image analysis device. For example, the shape factor SF1 may be calculated in the following manner. An optical microscopic image of toner particles scattered over a surface of a slide glass is input into a LUZEX image analysis device through a video camera. Then, the maximum length and the projected area of 100 or more toner particles are determined and calculation is performed with Formula (II) above. The resultant values are averaged to thereby provide the shape factor SF1.

When the shape factor SF1 of a toner is less than 110 or more than 140, there are cases where excellent charging properties, cleaning properties, and transfer properties are not provided for a long period of time.

The shape factor has been recently often determined with an FPIA-3000 manufactured by SYSMEX CORPORATION because the FPIA-3000 enables easy measurement. When the FPIA-3000 is used, images of about 4000 particles are optically measured and a projected image of each particle is analyzed. Specifically, the boundary length of a single particle (boundary length of particle image) is calculated from a projected image of the single particle. Then, the area of the particle in the projected image is calculated. A circle having the same area as the calculated area is assumed and the circumference of the circle is calculated (circumferential length of circle determined from circle equivalent diameter). The circularity is calculated from the following formula: Circularity=(circumferential length of circle determined from circle equivalent diameter)/(boundary length of particle image). The closer the circularity is to 1.0, the closer the shape is to a sphere. The circularity is preferably 0.945 or more and 0.990 or less, and more preferably 0.950 or more and 0.975 or less. When the circularity is less than 0.950, there are cases where the transfer efficiency is lowered. When the circularity is more than 0.975, there are cases where cleaning properties are poor.

Although there is variation between devices, a shape factor SF1 of 110 is approximately equivalent to a circularity of 0.990 measured with an FPIA-3000; and a shape factor SF1 of 140 is approximately equivalent to a circularity of 0.945 measured with an FPIA-3000.

Relationships Between Black Toners

The first black toner (corresponding to the toner A in the invention) and the second black toner (corresponding to the toner B in the invention) in the exemplary embodiment satisfy relationships (0), (1), and (2) and desirable relationships (x) and (3). These relationships between the toner A and the toner B will be described.

The discussion below in terms of, in particular, the relationships of physical properties is based on toner particles that do not include external additives. However, the influence of external additives in the measurement of physical properties is negligible and hence externally added toner particles and toner particles without external additives may be used in the measurement of physical properties.

Relationships in the Exemplary Embodiment (0) Relationship in which 90 Mass % of Binder Resin of Toner B is Same Resin as 90 Mass % of the Binder Resin of Toner A As described above, the toner A is a high-viscosity toner and a fixed toner image formed from the toner A has a low glossiness (low gloss). In contrast, the toner B is a low-viscosity toner and a fixed toner image formed from the toner B has a high glossiness (high gloss). The viscosity of these toners is generally adjusted by changing the composition or the molecular weight of a binder resin. In this case, however, the fixing temperature is changed. As a result, the high-viscosity toner A has a high fixing temperature and the low-viscosity toner B has a low fixing temperature.

In the case of using the two toners in combination, which does not cause serious problems in normal usage, when an image is formed on a paper sheet on which images are fixed with a large amount of fixing heat such as a thick paper sheet, there are cases where the fixing strength of the high-viscosity toner A is insufficient. For the purpose of decreasing the fixing temperature of the high-viscosity toner A, the glass transition temperature of the high-viscosity toner A may be decreased by changing the composition or the molecular weight of a binder resin. However, in this case, the thermal storability of the toner is poor.

Accordingly, in the exemplary embodiment, 90 mass % or more of the binder resins of the toner A and the toner B are made to contain the same resin and, as a result, fixing characteristics of the toner A and the toner B are made close to each other. It is most desirable that the entirety of the binder resins of the toner A and the toner B be constituted by same resin. The viscosity (substantially corresponding to glossiness) of these toners are controlled in accordance with the relationship (2) described below.

The term "same resin" refers to a case where 90 mol % of polymerizable monomers constituting resins are identical. For example, consider a case where a copolymer A is composed of 100 parts of styrene and 100 parts of methyl methacrylate and a copolymer B is composed of 100 parts of styrene, 95 parts of methyl methacrylate, and 5 parts of methacrylic acid. The copolymer A is composed of 49.0 mol % of styrene and 51.0 mol % of methyl methacrylate and the copolymer B is composed of 48.8 mol % of styrene, 48.2 mol % of methyl methacrylate, and 2.9 mol % of methacrylic acid. Thus, 97.1 (=100−2.9) mol % of the polymerizable monomers are identical. Then the copolymer A and the copolymer B are regarded as a "same resin".

(1) Relationship of Ta>Tb where Ta Represents Flow Tester ½ Effluent Temperature of Toner A and Tb Represents Flow Tester ½ Effluent Temperature of Toner B A sample is measured with a flow tester (CFT-500C, manufactured by SHIMADZU CORPORATION) under conditions (sample amount: 1.05 g, sample diameter: 1 mm, preheating: 65° C. for 300 s, load: 10 kg, die size: 0.5 mm (diameter), and heating rate: 1.0° C./min). When the descent amount of the plunger is plotted, a temperature at which half of the sample has flowed out is defined as the "flow tester ½ effluent temperature".

When a material has a high flow tester ½ effluent temperature, the material has a high viscosity. When a material has a low flow tester ½ effluent temperature, the material has a low viscosity. Accordingly, when roughly put, the physical property relationship (1) represents that, compared with the toner A, the toner B has a low viscosity and an image having a high gloss is formed with the toner B.

To ensure the effectiveness of the role sharing of the toners, the relationship of Ta>Tb×1.05 is preferably satisfied and, more preferably, the relationship of Ta>Tb×1.10 is satisfied.

As for specific values of the flow tester ½ effluent temperature, Ta is preferably in the range of 115° C. to 145° C. and, more preferably, in the range of 120° C. to 140° C.; and Tb is preferably in the range of 95° C. to 115° C. and, more preferably, in the range of 100° C. to 110° C.

(2) Relationship of Aa>Ab where Aa Represents Aluminum Amount (with Reference to Net Intensity) of Toner A Measured with Fluorescent X-Ray and Ab Represents Aluminum Amount (with Reference to Net Intensity) of Toner B Measured with Fluorescent X-Ray As described above, in the exemplary embodiment, the flow tester ½ effluent temperature is controlled not by adjusting the composition or the molecular weight of a binder resin but by adjusting the aluminum amount in a toner. Specifically, in the exemplary embodiment, the flow tester ½ effluent temperature is controlled by utilizing a property in which the presence of aluminum in a toner results in the generation of ionic crosslinking between the aluminum and a polyester resin to thereby enhance the elasticity of the toner.

The atomic radius and the coordination number of aluminum are desirable for adjusting the viscosity of toner for fixing. As for metals other than aluminum, for example, iron and copper have too large atomic radii; and calcium and potassium have insufficient coordination numbers. By making an appropriate amount of aluminum present in a toner, a toner exhibiting a desirable elastic modulus of about 100 Pa to 10,000 Pa in fixing is provided.

The aluminum amounts (with reference to net intensity) in the toners may be adjusted such that the flow tester ½ effluent temperatures of the toners satisfy the preferred ranges.

The aluminum amount of a toner may be determined from a composition ratio calculated from the analytic result of all the elements of the toner by X-ray fluorescence analysis. For example, the X-ray fluorescence analysis may be performed by conducting quantitative analysis with a measurement apparatus (XRF-1500, manufactured by SHIMADZU CORPORATION) under measurement conditions of a tube voltage of 40 kV, a tube current of 70 mA, a measurement time of 15 minutes, and a measurement area corresponding to a diameter of 10 mm (0.3 g of a sample is formed into a tubular shape having a diameter of 10 mm). Thus, the net intensity in terms of aluminum amount is determined. Similarly, sodium amount described below may be determined.

As described above, the aluminum amount in a toner may be adjusted by using an appropriate amount of an aggregating agent containing aluminum in the production of the toner. Aluminum may also be added by using alumina as the above-described dispersing agent. For the purpose of only adding an aluminum component, an aluminum salt may be separately added to a dispersion medium or the like in the preparation of a toner.

Desirable Physical Properties in the Exemplary Embodiment (x) Relationship of Da>Db where Da Represents Volume Average Particle Size of Toner A and Db Represents Volume Average Particle Size of Toner B In general, fixed images have irregularities having the size of toner particles. When the toner particles have a small size, the irregularities have a small size and light scattering in the surfaces of the images increases. As a result, the degree of black color of the images appears degraded. To reduce the light scattering, the low-glossiness (low-gloss) toner A desirably has a large toner particle size.

In contrast, the high-glossiness (high-gloss) toner B, which is used to form photographic images, high-resolution images, and full-color images, desirably has a small toner particle size in view of fine-line reproducibility.

Accordingly, the relationship of Da>Db is desirable where Da represents the volume average particle size of the toner A and Db represents the volume average particle size of the toner B. As for a proper difference between the volume average particle sizes of the toners, the relationship of Da>Db×1.05 is preferably satisfied and, more preferably, the relationship of Da>Db×1.10 is satisfied.

Specifically, the toner A preferably has a volume average particle size of 4.0 μm or more and 10.0 μm or less and, more preferably, 5.0 μm or more and 8.0 μm or less. Specifically, the toner B preferably has a volume average particle size of 3.0 μm or more and 7.0 μm or less, and more preferably, 3.5 μm or more and 6.5 μm or less.

The measurement of the volume average particle size may be performed with a Multisizer II (manufactured by Beckman Coulter, Inc.) at an aperture size of 100 μm. In this case, the measurement may be performed after the steps of dispersing a toner (at a concentration of 1 mass %) in an aqueous solution of an electrolyte (aqueous solution of ISOTON), adding a surfactant (trade name: Contaminon) to the aqueous solution, and dispersing the surfactant with an ultrasonic dispersion apparatus for 300 seconds or more.

(3) Relationship of Naa>Nab where Naa Represents Sodium Amount of Toner A Measured with Fluorescent X-Ray and Nab Represents Sodium Amount of Toner B Measured with Fluorescent X-Ray To satisfy the relationship (x), when the particle size of the toner A is increased, the amount of the toner for uniformly covering an image region increases. Such an increase in the amount of the toner naturally results in an increase in the heat quantity in fixing. Thus, the fixing temperature is increased.

To address such a problem, by controlling the sodium amount (Na amount) in a toner and utilizing the plasticizing effect due to the interaction between carboxylic acid and sodium, the fixing temperatures of toners having different particle sizes may be made close to each other. As a result, when various paper sheets, for example, paper sheets having different thicknesses are used, fixing properties of toner images formed of toners having different particle sizes may be made close to each other.

By making a toner contain sodium, the sodium and the carboxylic acid of a polyester resin interact with each other and the polyester resin is plasticized. Accordingly, the relationship (3) in which the sodium amount of the toner A having a large particle size and desirably having a low fixing temperature is made larger than the sodium amount of the toner B having a small particle size is desirable.

In this case, too large a sodium amount causes excessive plasticization and the entire strength of the resin is decreased. Thus, the anti-blocking property is degraded. However, too small a sodium amount does not provide sufficient plasticization and the fixing temperature is not decreased. Accordingly, it is desired that the sodium amount be appropriately controlled in accordance with a desired plasticization.

As described above, the plasticization caused by sodium is based on the interaction between sodium and the carboxylic acid of a polyester resin. Since almost the carboxylic acid of a polyester resin is present in the end groups of the polyester resin, the interaction substantially does not affect the main chain of the polyester. As a result, the glass transition temperature and the strength of the polyester resin are maintained and the anti-blocking property is also provided. When a plasticizing agent is used, the plasticizing effect is expected. However, the interaction between the plasticizing agent and the main chain of polyester is caused and, for example, there is a probability that the glass transition temperature of the polyester resin is decreased.

As a method of controlling the sodium amount in a toner, there are a method of adding sodium in the preparation of a resin dispersion, a method of adding sodium during the preparation of the toner, a method of adding sodium after the preparation of the toner, and the like. It is desirable that the sodium amount in a toner be controlled with the amount of sodium added in the preparation of the toner. When the sodium amount is too small, there are cases where the particle size controllability of a toner is degraded. Thus, the sodium amount may be controlled by adding a large amount of sodium in the preparation of a toner and, after the preparation of the toner, adjusting the pH with an acid such as nitric acid or hydrochloric acid. Examples of a material usable for adding sodium include sodium hydroxide, surfactants having been neutralized with Na, and the like. Of these, sodium hydroxide is preferred.

As described above, as in the aluminum amount, the sodium amount in a toner is measured with fluorescent X-ray.

Two-component Developer

The black toner having been described so far in the exemplary embodiment may be used as a one-component developer composed of the black toner only or a two-component developer composed of a mixture of the black toner and carriers.

Usable carriers are not particularly limited; however, carriers coated with a resin (in general, referred to as "coated carriers", "resin-coated carriers", or the like) are desirable and carriers coated with a nitrogen-containing resin are more desirable. Examples of a nitrogen-containing resin suitably used for the coating include acrylic resins such as dimethylaminoethyl methacrylate, dimethyl acrylamide, and acrylonitrile; amino resins such as urea resins, urethane resins, melamine resins, guanamine resins, and aniline resins; amide resins; urethane resins; copolymer resins of the foregoing. Of these, in particular, urea resins, urethane resins, melamine resins, and amide resins are preferred.

As a coating resin for carriers, two or more resins may be combined from the above-described nitrogen-containing resins; or one or more of the above-described nitrogen-containing resins and a resin containing no nitrogen may be combined. In addition, one or more of the above-described nitrogen-containing resins may be formed into particles and dispersed in a resin containing no nitrogen.

In general, in view of the function of carriers, carriers desirably have appropriate electrical resistance, specifically, in the range of $10^9$ Ωcm or more and $10^{14}$ Ωcm or less. For example, when iron powder carriers having a low electrical resistance of $10^6$ Ωcm are used, it is desirable that the carriers are coated with an insulating resin (having a volume resistivity of $10^{14}$ Ωcm or more) and a conductive powder is dispersed in the resin-coated layers.

A specific example of the conductive powder include a powder of metal such as gold, silver, or copper; a powder of carbon black; a powder of a semiconductive oxide such as titanium oxide or zinc oxide; and a powder of titanium oxide, zinc oxide, barium sulfate, aluminum borate, or potassium titanate whose particle surfaces are covered with tin oxide, carbon black, or a metal. Of these, a powder of carbon black is preferred.

As a method for forming the resin-coated layers on the surfaces of carrier cores, for example, there are a dipping method in which a carrier-core powder is dipped in a solution for forming resin-coated layers; a spraying method in which a solution for forming resin-coated layers is sprayed onto the surfaces of carrier cores; a fluidized bed method in which a solution for forming resin-coated layers is sprayed onto the surfaces of carrier cores being floated with air flow; a kneader-coater method in which carrier cores and a solution for forming resin-coated layers are mixed together in a kneader-coater and a solvent is removed from the mixture; and a powder coating method in which a resin for coating is turned into particles, mixed with carrier cores at a temperature equal to or higher than the melting point of the resin in a kneader-coater, and cooled to thereby coat the carrier cores with the resin. Of these, in particular, the kneader-coater method and the powder coating method are preferred.

Carriers may be produced with a heating kneader, a heating Henschel mixer, a UM mixer, or the like. Depending on the amount of the resin for coating, a heating fluidized rolled bed, a heating kiln, or the like may be used.

The resin-coated layers formed by the above-described methods generally have an average film thickness in the range of 0.1 μm or more and 10 μm or less and, desirably in the range of 0.2 μm or more and 5 μm or less.

A material for forming the cores of carriers (carrier cores) is not particularly limited. Examples of such a core material include magnetic metals such as iron, steel, nickel, and cobalt; magnetic oxides such as ferrite and magnetite; and glass beads. In particular, when a magnetic brush method is used, a magnetic metal is desirably used. In general, carrier cores preferably have a number average particle size of 10 μm or more and 100 μm or less and, more preferably, 20 μm or more and 80 μm or less.

The mixing ratio of the black toner to the carriers in the two-component developer is not particularly limited and may be appropriately selected in accordance with a purpose. However, the mixing ratio of the toner to the carriers is preferably, on the basis of mass, in the range of about 1:100 to 30:100 and, more preferably, in the range of about 3:100 to 20:100.

Thus, an image forming apparatus and an image forming method according to an exemplary embodiment of the invention have been described in detail so far. However, the invention is not restricted to the exemplary embodiment. For example, in the exemplary embodiment, two black toners functioning as the toners A and B according to the invention are contained in developing devices (developed-image forming devices). However, the hue of the toners A and B is not limited to black and a combination of two toners having similar colors that belong to cyan, magenta, yellow, or the like may be used.

In the exemplary embodiment, the image forming apparatus is described as an example in which latent images corresponding to colors are formed on the single electrostatic-latent-image holding member 201 by using the rotary developing unit 204 including developing devices whose number corresponds to the number of the colors, and the latent images are transferred onto the intermediate transfer member 207 one by one. Alternatively, a tandem-system image forming apparatus may be used in which color units each including an electrostatic-latent-image holding member, a charging section, a developed-image forming device, a cleaning section, and the like are disposed side by side (the color units are not necessarily arranged in a linear line) so as to face an intermediate transfer member; color toner images formed in the units are sequentially subjected to first transfer onto the intermediate transfer member and stacked; and the toner images are collectively subjected to second transfer onto a recording medium.

The above-described features of the image forming apparatus and the image forming method according to the exemplary embodiment may be combined with one or more of various features including existing features and features that are not publicly known at present. As a result of such a combination, when the resultant image forming apparatus and the resultant image forming method have the features of the invention, the image forming apparatus and the image forming method are in the scope of the invention. For example, a charge erasing section may be further disposed downstream of the cleaning section.

In addition, those skilled in the art may appropriately modify the image forming apparatus and the image forming method according to the exemplary embodiment in accordance with existing findings. As a result of such a modification, when the resultant image forming apparatus and the resultant image forming method have the features of the invention, the image forming apparatus and the image forming method are in the scope of the invention.

EXAMPLES

Hereinafter, exemplary embodiments according to the invention will be more specifically described in detail with reference to examples and comparative examples. However, the invention is not restricted to these examples. All the terms "part" and "%" are based on mass unless otherwise specified.

Measurement Conditions and Measurement Methods

Measurement of Acid Value

An acid value AV is measured by a neutralization titration method in accordance with JIS K0070. Specifically, an appropriate amount of a sample is taken and mixed with 100 ml of a solvent (50:50 mixture solution of acetone and toluene) and a few drops of an indicator (phenolphthalein solution). The resultant mixture is sufficiently shaken in a water bath until the sample has been completely dissolved in the solvent. This mixture is titrated with a 0.1 mol/l ethanol solution of potassium hydroxide. The point at which the pale red color of the indicator continues for 30 seconds is regarded as the end point.

The acid value is calculated with the following formula:

$$A=(B\times f\times 5.611)/S$$

where A represents the acid value, S (g) represents the amount of the sample, B (ml) represents the volume of the 0.1 mol/l ethanol solution of potassium hydroxide used in the titration, and f represents the factor of the 0.1 mol/l ethanol solution of potassium hydroxide.

Measurement Methods of Glass Transition Temperature and Melting Temperature

The glass transition temperature and the melting temperature are measured by differential scanning calorimetry in accordance with ASTMD 3418-8. This measurement is performed in the following manner.

A sample is set in a differential scanning calorimeter (apparatus name: DSC-50, manufactured by SHIMADZU CORPORATION) equipped with an automatic tangential line processing system. Next liquid nitrogen as a cooling medium is set in a differential scanning calorimeter. Then, the sample is heated from 20° C. to 150° C. at a heating rate of 10° C./min (first temperature increase process) and the relationship between temperature (° C.) and heat value (mW) is determined. Then, the sample is cooled to 0° C. at a cooling rate of −10° C./min and again heated to 150° C. at a heating rate of 10° C./min (second temperature increase process) and the data is collected. In the measurement, the sample is held at 0° C. and 150° C. for 5 minutes. The temperature at the endothermic peak in the second temperature increase process is regarded as the melting temperature. If a crystalline resin may have plural melting peaks, the melting temperature is the temperature at the maximum peak.

As for the detection part of the differential scanning calorimeter, temperature correction is performed on the basis of the melting temperature of an amalgam of indium and zinc and heat-value correction is performed on the basis of the heat of melting of indium. The sample is put into an aluminum pan and the aluminum pan including the sample and an empty aluminum pan for reference are set in the apparatus.

Measurement of Weight Average Molecular Weight (Mw)

The weight average molecular weight (Mw) of a polyester resin is measured with a GPC apparatus (HLC-8120GPC, SC-8020, manufactured by Tosoh Corporation) with two columns (TSKgel, Super HM-H (6.0 mm ID×15 cm×2) manufactured by Tosoh Corporation), and THF (tetrahydrofuran) for chromatography (manufactured by Wako Pure Chemical Industries, Ltd.) as an eluent. The experiment is carried out using an IR detector under the following experimental conditions: sample concentration of 0.5%, flow rate of 0.6 ml/min, sample injection amount of 10 μl, and determination temperature 40° C. Further, the calibration curve is prepared from 10 samples, "Polystyrene Standard Sample TSK Standard": "A-500", "F-1", "F-10", "F-80", "F-380", "A-2500", "F-4", "F-40", "F-128", and "F-700" (manufactured by Tosoh Corporation).The interval for collecting the data in the sample analysis is 300 ms.

Calculation of Circularity

The shape factor of a toner is measured with an FPIA-3000 (manufactured by SYSMEX CORPORATION). A toner dispersion for the measurement is prepared in the following manner. Two drops of a 10 mass % solution of a surfactant (Contaminon, manufactured by Wako Pure Chemical Industries, Ltd.) as a dispersant are dropped into the 30 ml of ion-exchanged water in the 100 ml beaker. Then, 20 mg of a toner are added into the solution and dispersed by ultrasonic dispersion for 3 minutes. Thus, the dispersion is prepared.

The thus-prepared toner dispersion is measured with the FPIA-3000 (manufactured by SYSMEX CORPORATION) in terms of 4,500 toner particles. Then, the circularity of the toner particles is calculated.

Measurement Method for Toner Volume Average Particle Size

The volume average particle size of toner particles is measured with a Coulter Multisizer-II measurement apparatus (manufactured by Beckman Coulter, Inc.). As an electrolytic solution, ISOTON-II (manufactured by Beckman Coulter, Inc.) is used.

Measurement of Flow Tester ½ Effluent Temperature

The flow tester ½ effluent temperature is measured in the above-described manner.

Preparation of Components of Toner

Preparation of Coloring Agent Dispersion (PK1)

Carbon black (R330, manufactured by Cabot Corporation): 200 parts by mass

Anionic surfactant (Neogen SC, manufactured by DAI-ICHI KOGYO SEIYAKU CO., LTD.): 33 parts by mass (active component: 60 mass %, 10 mass % with respect to coloring agent)

Ion-exchanged water: 750 parts by mass

A stainless steel container having the following size is used: when all these components are put into the container, the liquid level is at about ⅓ of the height of the container. 280 parts by mass of the ion-exchanged water and the anionic surfactant are put in the container. The mixture is heated to 40° C., and the surfactant is fully dissolved in the water and then cooled to 25° C. Then the carbon black pigment is put into the container. The mixture is stirred with a stirrer until the all pigment are wet, and fully defoamed.

The remainder of the ion-exchanged water is put into the defoamed mixture and dispersed with a homogenizer (ULTRA-TURRAX T50, manufactured by IKA JAPAN) at 5,000 rpm for 10 minutes, then stirred with a stirrer for a day and a night to be defoamed. The defoamed mixture is again dispersed with the homogenizer at 6,000 rpm for 10 minutes and then stirred with a stirrer for a day and a night to be defoamed. The dispersion is dispersed with a high-pressure impact dispersion apparatus Ultimaizer (HJP 30006, manufactured by SUGINO MACHINE LIMITED) at a pressure of 240 MPa. This dispersion performed is equivalent to 25 passes in terms of the total charged amount and the processing capability of the apparatus.

The obtained dispersion is left for 72 hours and the precipitate is removed. The dispersion is then mixed with ion-exchanged water such that the concentration of the solid content is 15 mass %. The particles in the coloring agent dispersion has a volume average particle size $D_{50V}$ of 125 nm and coarse particles having a size of 250 nm or more are not observed. The volume average particle size $D_{50V}$ is determined in the following manner. The volume average particle size is measured five times with a Microtrac and the three measurement values (the maximum value and the minimum value are excluded from the measurement values) are averaged to provide the volume average particle size $D_{50V}$. The coloring agent dispersion is defined as PK1.

Preparation of Release Agent Dispersion (W1)

Hydrocarbon wax (trade name: FNP 0090, manufactured by NIPPON SEIRO CO., LTD., melting temperature Tw: 90.2° C.): 270 parts by mass Anionic surfactant (Neogen RK, manufactured by DAI-ICHI KOGYO SEIYAKU CO., LTD., active component amount: 60 mass %): 13.5 parts by mass (active component: 3.0 mass % with respect to release agent)

Ion-exchanged water: 21.6 parts by mass

These components are mixed and the release agent is melted with a pressure discharge homogenizer (Gaulin homogenizer, manufactured by Gaulin Corporation) at an internal fluid temperature of 120° C. The mixture is then subjected to dispersion treatments at a dispersion pressure of 5 MPa for 120 minutes and then at 40 MPa for 360 minutes and cooled. Thus, a release agent dispersion (W1) is obtained. The particles in the release agent dispersion have a volume average particle size $D_{50V}$ of 225 nm. Then, the release agent dispersion (W1) is mixed with ion-exchanged water such that the concentration of the solid content is 20.0 mass %.

Synthesis of Amorphous Polyester Resin (A1)

Propylene oxide adduct of bisphenol A (NEWPOL BP-2P, manufactured by Sanyo Chemical Industries, Ltd.): 80 molar parts Ethylene oxide adduct of bisphenol A (NEWPOL BPE-20, manufactured by Sanyo Chemical Industries, Ltd.): 20 molar parts Terephthalic acid: 55 molar parts Fumaric acid: 32 molar parts Dodecenylsuccinic anhydride: 15 molar parts Trimellitic anhydride: 1 molar part The above-described monomer components other than the fumaric acid and the trimellitic anhydride, and 0.25 parts by mass of tin dioctanoate with respect to 100 parts by mass of the total of the above-described monomer components are put in the reaction vessel equipped with a stirrer, a thermometer, a condenser, and a nitrogen gas introduction tube. The reaction of the mixture is conducted at 235° C. for 6 hours under nitrogen gas flow. The reaction solution is then cooled to 200° C. and mixed with the fumaric acid to react for an hour. Furthermore, the reaction solution is mixed with the trimellitic anhydride to react for an hour and then heated to 220° C. over 4 hours so that polymerization is conducted at a pressure of 10 kPa to achieve a desired molecular weight. Thus, an amorphous polyester resin (A1) that has pale yellow and transparent is obtained.

The obtained amorphous polyester resin (A1) has a glass transition temperature Tg of 59° C. measured by DSC, a weight average molecular weight Mw of 21,000 and a number average molecular weight Mn of 7,100 measured by GPC, a softening temperature of 107° C. measured with a flow tester, and an acid value AV of 11 mg KOH/g.

Synthesis of Amorphous Polyester Resin (A2)

Propylene oxide adduct of bisphenol A (NEWPOL BP-2P, manufactured by Sanyo Chemical Industries, Ltd.): 30 molar parts Ethylene oxide adduct of bisphenol A (NEWPOL BPE-20, manufactured by Sanyo Chemical Industries, Ltd.): 70 molar parts Terephthalic acid: 68 molar parts Dodecenylsuccinic anhydride: 25 molar parts Trimellitic anhydride: 7 molar parts These components are processed in a manner similar to that in "Synthesis of amorphous polyester resin (A1)". As a result, an amorphous polyester resin (A2) that has pale yellow and transparent is obtained. The thus-obtained amorphous polyester resin (A2) has a glass transition temperature Tg of 56° C. measured by DSC, a weight average molecular weight Mw of 85,000 and a number average molecular weight Mn of 9,000 measured by GPC, a softening temperature of 125° C. measured with a flow tester, and an acid value AV of 13 mg KOH/g.

Synthesis of Amorphous Polyester Resin (B1)

Propylene oxide adduct of bisphenol A (NEWPOL BP-2P, manufactured by Sanyo Chemical Industries, Ltd.): 80 molar parts Ethylene oxide adduct of bisphenol A (NEWPOL BPE-20, manufactured by Sanyo Chemical Industries, Ltd.): 20 molar parts Terephthalic acid (reagent): 70 molar parts Cyclohexane dicarboxylic acid (reagent): 30 molar parts The above-described components are put in a reaction vessel equipped with a stirrer, a thermometer, a condenser, and a nitrogen gas introduction tube. The reaction vessel is purged with dry nitrogen gas. Then, 0.25 parts by mass of tin dioctanoate is added with respect to 100 parts by mass of the total of the above-described monomer components. The reaction of the mixture is conducted at about 180° C. for about 6 hours under nitrogen gas flow while the mixture is stirred. The resultant reaction solution is then heated to about 220° C. over an hour and the reaction of the solution is conducted for about 7 hours while the solution is stirred. The solution is then heated to 235° C. and the pressure within the reaction vessel is decreased to 10.0 mmHg. The reaction of the solution is conducted for about 2.0 hours under the reduced pressure while the solution is stirred. Thus, an amorphous polyester resin (B1) that has colorless and transparent is obtained.

The thus-obtained amorphous polyester resin (B1) has a glass transition temperature Tg of 52.5° C. measured by DSC, a weight average molecular weight Mw of 18,000 and a number average molecular weight Mn of 6,300 measured by GPC, and an acid value AV of 9.3 KOH mg/g.

Synthesis of Amorphous Polyester Resin (B2)

Propylene oxide adduct of bisphenol A (NEWPOL BP-2P, manufactured by Sanyo Chemical Industries, Ltd.): 40 molar parts Ethylene oxide adduct of bisphenol A (NEWPOL BPE-20, manufactured by Sanyo Chemical Industries, Ltd.): 60 molar parts Terephthalic acid: 68 molar parts Fumaric acid: 25 molar parts Trimellitic anhydride: 7 molar parts These components are processed in a manner similar to that in "Synthesis of amorphous polyester resin (A1)". As a result, an amorphous polyester resin (B2) that has pale yellow and transparent is obtained. The thus-obtained amorphous polyester resin (B2) has a glass transition temperature Tg of 57° C. measured by DSC, a weight average molecular weight Mw of 95,000 and a number average molecular weight Mn of 8,500 measured by GPC, a softening temperature of 127° C. measured with a flow tester, and an acid value AV of 14 mg KOH/g.

Synthesis of Crystalline Polyester Resin (C1)

1,10-Dodecanedioic acid: 50 mol %

1,9-Nonanediol: 50 mol %

The above-described monomer components are put in a reaction vessel equipped with a stirrer, a thermometer, a condenser, and a nitrogen gas introduction tube. The reaction vessel is purged with dry nitrogen gas. Then, 0.25 parts by mass of titanium tetrabutoxide (reagent) is added with respect to 100 parts by mass of the above-described monomer components. The reaction of the mixture is conducted at 170° C. for 3 hours under nitrogen gas flow while the mixture is stirred. The resultant reaction solution is then heated to 210° C. over an hour and the pressure within the reaction vessel is decreased to 3 kPa. The reaction of the solution is conducted for 13 hours under the reduced pressure while the solution is stirred. Thus, a crystalline polyester resin (C1) is obtained.

The thus-obtained crystalline polyester resin (C1) has a melting temperature Tc of 73.6° C. measured by DSC, a weight average molecular weight Mw of 25,000 and a number average molecular weight Mn of 10,500 measured by GPC, and an acid value AV of 10.1 mg KOH/g.

Preparation of Amorphous Polyester Resin Particle Dispersion (PA1)

Amorphous polyester resin (A1): 3,000 parts

Ion-exchanged water: 10,000 parts

Surfactant (sodium dodecylbenzenesulfonate): 90 parts

These components are put into an emulsification tank of a high-temperature high-pressure emulsification apparatus (trade name CAVITRON CD1010, slit: 0.4 mm, manufactured by EUROTEC, LTD), heated and dissolved at 130° C., dispersed at 110° C. at a flow rate of 3 l/m at 10,000 rpm for 30 minutes, and passed through a cooling tank. Thus, an amorphous resin particle dispersion is collected and passed through a wire mesh having 105 μm openings. Thus, an amorphous polyester resin particle dispersion is provided.

The resin particles in the dispersion have a volume average particle size $D_{50V}$ of 260 nm. After that, the dispersion is mixed with ion-exchanged water such that the concentration of the solid content is 20 mass %. The resultant dispersion is defined as an amorphous polyester resin particle dispersion (PA1).

Preparation of Amorphous Polyester Resin Particle Dispersion (PA2)

While a 3-liter jacketed reaction vessel equipped with a condenser, a thermometer, a water dropping device, and an anchor blade (BJ-30N, manufactured by TOKYO RIKAKIKAI CO., LTD.) is maintained at 40° C. in a water-circulation constant-temperature bath, the reaction vessel is charged with a solvent mixture of 160 parts by mass of ethyl acetate and 100 parts by mass of isopropyl alcohol and then with 300 parts by mass of the amorphous polyester resin (A2). The resultant mixture is stirred with a three-one motor at 120 rpm such that the resin is dissolved in the solvent mixture to thereby provide an oil phase. While the oil phase is stirred, 18 parts by mass of a 10 mass % aqueous solution of ammonia are dropped into the oil phase and mixed for 10 minutes. Then, 900 parts by mass of ion-exchanged water are further dropped into the oil phase at a rate of 5 parts by mass per minute and phase inversion is caused. Thus, an emulsion is provided.

Immediately, 800 parts by mass of the thus-prepared emulsion and 1,000 parts by mass of ion-exchanged water are put into a 2-liter recovery flask. The recovery flask is connected through a spherical evaporator trap to an evaporator equipped with a vacuum control unit (manufactured by TOKYO RIKAKIKAI CO., LTD.). While the recovery flask is rotated, the recovery flask is heated in a hot-water bath at 60° C. In this heating, while care is taken for bumping, the pressure within the recovery flask is decreased to 7 kPa and the solvent is removed. When the amount of the solvent collected reaches 1,400 parts by mass, normal pressure is applied in the recovery flask and the recovery flask is cooled with water to provide a dispersion. The thus-prepared solution has no solvent odor. The resin particles in the dispersion have a volume average particle size $D_{50V}$ of 140 nm. After that, the dispersion is mixed with ion-exchanged water such that the concentration of the solid content is 20 mass %. The resultant solution is defined as an amorphous polyester resin particle dispersion (PA2).

Preparation of Crystalline Polyester Resin Particle Dispersion (PC1)

A dispersion prior to the adjustment of the concentration of the solid content is prepared in a manner similar to that in the "Preparation of amorphous polyester resin particle dispersion (PA1)" except that the amorphous polyester resin (A1) is substituted by the crystalline polyester resin (C1).

The resin particles in the dispersion have a volume average particle size $D_{50V}$ of 220 nm. After that, ion-exchanged water adds into the dispersion such that the concentration of the solid content is 20 mass %. The resultant dispersion is defined as a crystalline polyester resin particle dispersion (PC1).

Preparation of Aluminum Sulfate Aqueous Solution (SA)

Aluminum sulfate powder (17% aluminum sulfate, manufactured by ASADA CHEMICAL INDUSTRY CO., LTD.): 35 parts by mass Ion-exchanged water: 1,965 parts by mass These components are charged into a 2-liter vessel and stirred and mixed until precipitate has disappeared. Thus, an aluminum sulfate aqueous solution (SA) is prepared.

Preparation of Additional Amorphous Polyester Resin Particle dispersion (PA2A)

A 500 ml beaker is charged with 350 parts by mass of the amorphous polyester resin particle dispersion (PA2). While this dispersion is stirred with a magnetic stirrer at a rate at which bubbles are not entrapped into the dispersion, the pH of the dispersion is adjusted to 3.0 with nitric acid. Thus, an additional amorphous polyester resin particle dispersion (PA2A) is provided.

Example 1

Preparation of Black Toner (TK1L)

Amorphous polyester resin particle dispersion (PA1): 200 parts by mass

Amorphous polyester resin particle dispersion (PA2): 450 parts by mass

Crystalline polyester resin particle dispersion (PC1): 55 parts by mass

Coloring agent dispersion (PK1): 90 parts by mass

Release agent dispersion (W1): 130 parts by mass

Ion-exchanged water: 250 parts by mass

These components are charged into a 3-liter reaction vessel equipped with a thermometer, a pH meter, and a stirrer. The pH of the resultant mixture is adjusted at 25° C. to 3.0 with nitric acid. Then, while the resultant mixture is dispersed with a homogenizer (ULTRA-TURRAX T50, manufactured by IKA JAPAN) at 5,000 rpm, 130 parts by mass of the prepared aluminum sulfate aqueous solution (SA) is added to the mixture and dispersed for 6 minutes.

After that, a stirrer and a mantle heater are attached to the reaction vessel. And the number of rotations of the stirrer is adjusted such that the resultant slurry is sufficiently stirred, and the slurry is heated to 40° C. at a heating rate of 0.2° C./min and then to a temperature more than 40° C. at a heating rate of 0.05° C./min. In this process, the particle size is measured with a Multisizer II (manufactured by Beckman Coulter, Inc., aperture size: 50 μm) every 10 minutes. When the volume average particle size has reached 5.0 μm, the temperature of the slurry is maintained. Then, the entirety of the additional amorphous polyester resin particle dispersion (PA2A) is added to the slurry over 60 minutes.

Then, after 6 parts by mass of EDTA (trade name: CHELEST 40, manufactured by CHELEST CORPORATION) are put over 10 minutes, the pH of the slurry is then adjusted to 9.0 with an aqueous solution of sodium hydroxide. After that, the slurry is heated to 90° C. at a heating rate of 1° C./min. Then, the slurry is maintained at 90° C. The shape and surface properties of the particles are observed with an optical microscope and a scanning electron microscope (FE-SEM) and the circularity of the particles is measured every 15 minutes. After 2.0 hours have elapsed, coalescing of the particles is observed. Then, the vessel is cooled to 30° C. with cooling water over 5 minutes.

The thus-cooled slurry is passed through a nylon mesh having 15 μm openings so that coarse particles are removed. The resultant toner slurry is filtrated with an aspirator under reduced pressure. Then, the toner is filtrated with ion-exchanged water at 30° C. The toner is washed by repeating this process until the conductivity of the filtrate becomes 10 μS/cm or less.

The thus-washed toner is pulverized with a wet-dry particle sizing apparatus (COMIL) into fine particles and subjected to vacuum drying in an oven at 35° C. for 36 hours to provide toner particles. These toner particles are mixed with 1.0 part by mass of hydrophobic silica (RY50 manufactured by NIPPON AEROSIL CO., LTD.) and 0.8 parts by mass of hydrophobic titanium oxide (T805 manufactured by NIPPON AEROSIL CO., LTD.) with respect to 100 parts by mass of the toner particles. The resultant mixture is blended with a sample mill at 13,000 rpm for 30 seconds. After that, the resultant mixture is sifted with an oscillating sieve having 45 μm openings. Thus, a black toner (TK1L) for high-gloss images is provided.

The thus-prepared black toner (TK1L) has a volume average particle size $D_{50V}$ of 6.0 μm and a circularity of 0.965 (FPIA-3000 manufactured by SYSMEX CORPORATION). An SEM image of the toner is observed. As a result, the toner particles have smooth surfaces and no defect such as projection of the release agent or separation of surface layers is observed.

Furthermore, the thus-prepared black toner (TK1L) is measured in terms of flow tester ½ effluent temperature and subjected to the measurements of aluminum amount and sodium amount with fluorescent X-ray in the above-described manner.

The measurement results are summarized in Table 1 below.

Preparation of Resin-Coated Carriers (C)

Mn—Mg—Sr ferrite particles (average particle size: 40 μm): 100 parts by mass

Toluene: 14 parts by mass

Cyclohexyl methacrylate/dimethylaminoethyl methacrylate copolymer (copolymerization mass ratio 99:1, Mw: 80,000):2.0 parts by mass Carbon black (VXC72, manufactured by Cabot Corporation): 0.12 parts by mass These components other than the ferrite particles and glass beads (diameter: 1 mm, amount: equal to the amount of the toluene) are mixed and stirred with a sand mill (manufactured by Kansai Paint Co., Ltd.) at 1,200 rpm for 30 minutes. Thus, a solution for forming resin-coated layers is obtained. This solution for forming resin-coated layers and the ferrite particles are put into a vacuum degassing kneader. The pressure within the kneader is reduced to evaporate toluene and the resultant mixture is dried. Thus, resin-coated carriers (C) are prepared.

Preparation of Black Developer (DK1L)

A black developer (DK1L) is prepared by mixing 500 parts by mass of the resin-coated carriers (C) with 40 parts by mass of the black toner (TK1L), blending the resultant mixture with a V-type blender for 20 minutes, and then removing aggregate by using an oscillating sieve having 212 μm openings.

Preparation of Black Replenishing Developer (SDK1L)

A black replenishing developer (SDK1L) is prepared by mixing 20 parts by mass of the resin-coated carriers (C) with 100 parts by mass of the black toner (TK1L), blending the resultant mixture with a V-type blender for 20 minutes, and then removing aggregate by using an oscillating sieve having 212 μm openings.

Preparation of Black Toner (TK1H)

Amorphous polyester resin particle dispersion (PA1): 200 parts by mass

Amorphous polyester resin particle dispersion (PA2): 450 parts by mass

Crystalline polyester resin particle dispersion (PC1): 55 parts by mass

Coloring agent dispersion (PK1): 90 parts by mass

Release agent dispersion (W1): 130 parts by mass

Ion-exchanged water: 250 parts by mass

These components are charged into a 3-liter reaction vessel equipped with a thermometer, a pH meter, and a stirrer. The pH of the resultant mixture is adjusted at 25° C. to 3.0 with nitric acid. Then, while the resultant mixture is dispersed with a homogenizer (ULTRA-TURRAX T50, manufactured by IKA JAPAN) at 5,000 rpm, 140 parts by mass of the prepared aluminum sulfate aqueous solution (SA) is added to the mixture and dispersed for 6 minutes.

After that, a stirrer and a mantle heater are attached to the reaction vessel. While the number of revolutions of the stirrer is adjusted such that the resultant slurry is sufficiently stirred, the slurry is heated to 40° C. at a heating rate of 0.2° C./min and then to a temperature more than 40° C. at a heating rate of 0.05° C./min. In this process, the particle size is measured with a Multisizer II (manufactured by Beckman Coulter, Inc., aperture size: 50 μm) every 10 minutes. When the volume average particle size has reached 5.0 μm, the temperature of the slurry is maintained. Then, the entirety of the additional amorphous polyester resin particle dispersion (PA2A) is added to the slurry over 60 minutes.

The pH of the slurry is then adjusted to 9.0 with an aqueous solution of sodium hydroxide. After that, the slurry is heated to 97° C. at a heating rate of 1° C./min and the slurry is maintained at 97° C. The shape and surface properties of the particles are observed with an optical microscope and a scanning electron microscope (FE-SEM) and the circularity of the particles is measured with a circularity measurement device (FPIA-3000, manufactured by SYSMEX CORPORATION) every 15 minutes. When the circularity has reached a desired value, the pH of the slurry is adjusted to 9.0 with an aqueous solution of sodium hydroxide and left for 5 minutes. Then, the vessel is cooled to 30° C. with cooling water over 5 minutes.

The thus-cooled slurry is passed through a nylon mesh having 15 μm openings so that coarse particles are removed. The resultant toner slurry is filtrated with an aspirator under reduced pressure. Then, the resultant toner is subjected to a process of filtration with ion-exchanged water at 30° C. The toner is washed by repeating this process until the conductivity of the filtrate becomes 10 μS/cm or less.

The thus-washed toner is pulverized with a wet-dry particle sizing apparatus (COMIL) into fine particles and subjected to vacuum drying in an oven at 35° C. for 36 hours to provide toner particles. These toner particles are mixed with 1.0 part by mass of hydrophobic silica (RY50 manufactured by NIPPON AEROSIL CO., LTD.) and 0.8 parts by mass of hydrophobic titanium oxide (T805 manufactured by NIPPON AEROSIL CO., LTD.) with respect to 100 parts by mass of the toner particles. The resultant mixture is blended with a sample mill at 13,000 rpm for 30 seconds. After that, the resultant mixture is sifted with an oscillating sieve having 45 μm openings. Thus, a black toner (TK1H) for low-gloss images is provided.

The thus-prepared black toner (TK1H) has a volume average particle size $D_{50V}$ of 6.1 μm and a circularity of 0.960 (FPIA-3000 manufactured by SYSMEX CORPORATION). As a result, the toner particles have smooth surfaces and no defect such as projection of the release agent or separation of surface layers is observed by SEM image of the toner.

Furthermore, the thus-prepared black toner (TK1H) is measured in terms of flow tester ½ effluent temperature and is measured in terms of the amount of aluminum and sodium with fluorescent X-ray in the above-described manner.

The measurement results are summarized in Table 1 below.

Preparation of Black Developer (DK1H)

A black developer (DK1H) is prepared in a manner similar to that in the "Preparation of black developer (DK1L)" except that the black toner (TK1H) is used instead of the black toner (TK1L).

Preparation of Black Replenishing Developer (SDK1H)

A black replenishing developer (SDK1H) is prepared in a manner similar to that in the "Preparation of black replenishing developer (SDK1L)" except that the black toner (TK1H) is used instead of the black toner (TK1L).

Example 2

In Example 2, for high-gloss images, the black toner (TK1L), the black developer (DK1L), and the black replenishing developer (SDK1L), which are the same as those in Example 1, are used. Hereinafter, a black toner (TK2H), a black developer (DK2H), and a black replenishing developer (SDK2H) for low-gloss images will be described.

Preparation of Black Toner (TK2H)

Amorphous polyester resin particle dispersion (PA1): 200 parts by mass

Amorphous polyester resin particle dispersion (PA2): 450 parts by mass

Crystalline polyester resin particle dispersion (PC1): 55 parts by mass

Coloring agent dispersion (PK1): 90 parts by mass

Release agent dispersion (W1): 130 parts by mass

Ion-exchanged water: 250 parts by mass

These components are charged into a 3-liter reaction vessel equipped with a thermometer, a pH meter, and a stirrer. The pH of the resultant mixture is adjusted at 25° C. to 3.0 with nitric acid. Then, while the resultant mixture is dispersed with a homogenizer (ULTRA-TURRAX T50, manufactured by IKA JAPAN) at 5,000 rpm, 140 parts by mass of the prepared aluminum sulfate aqueous solution (SA) is added to the mixture and dispersed for 6 minutes.

After that, a stirrer and a mantle heater are attached to the reaction vessel. While the number of revolutions of the stirrer is adjusted such that the resultant slurry is sufficiently stirred, the slurry is heated to 40° C. at a heating rate of 0.2° C./min and then to a temperature more than 40° C. at a heating rate of 0.05° C./min. In this process, the particle size is measured with a Multisizer II (manufactured by Beckman Coulter, Inc., aperture size: 50 μm) every 10 minutes. When the volume average particle size has reached 5.5 μm, the temperature of the slurry is maintained. Then, the entirety of the additional amorphous polyester resin particle dispersion (PA2A) is added to the slurry over 60 minutes.

The pH of the slurry is then adjusted to 9.2 with an aqueous solution of sodium hydroxide. After that, the slurry is heated to 97° C. at a heating rate of 1° C./min and the slurry is maintained at 97° C. The shape and surface properties of the particles are observed with an optical microscope and a scanning electron microscope (FE-SEM) and the circularity of the particles is measured with a circularity measurement device (FPIA-3000, manufactured by SYSMEX CORPORATION) every 15 minutes. When the circularity has reached a desired value, the pH of the slurry is adjusted to 9.0 with an aqueous solution of sodium hydroxide and left for 5 minutes. Then, the vessel is cooled to 30° C. with cooling water over 5 minutes.

The thus-cooled slurry is passed through a nylon mesh having 15 μm openings so that coarse particles are removed. The resultant toner slurry is filtrated with an aspirator under reduced pressure. Then, the resultant toner is subjected to a process of filtration with ion-exchanged water at 30° C. The toner is washed by repeating this process until the conductivity of the filtrate becomes 10 μS/cm or less.

The thus-washed toner is pulverized with a wet-dry particle sizing apparatus (COMIL) into fine particles and subjected to vacuum drying in an oven at 35° C. for 36 hours to obtain toner particles. These toner particles are mixed with 1.0 part by mass of hydrophobic silica (RY50 manufactured by NIPPON AEROSIL CO., LTD.) and 0.8 parts by mass of hydrophobic titanium oxide (T805 manufactured by NIPPON AEROSIL CO., LTD.) with respect to 100 parts by mass of the toner particles. The resultant mixture is blended with a sample mill at 13,000 rpm for 30 seconds. After that, the resultant mixture is sifted with an oscillating sieve having 45 μm openings. Thus, the black toner (TK2H) for low-gloss images is provided.

The thus-prepared black toner (TK2H) has a volume average particle size $D_{50V}$ of 6.4 μm and a circularity of 0.959 (FPIA-3000 manufactured by SYSMEX CORPORATION). An SEM image of the toner is observed. As a result, the toner particles have smooth surfaces and no defect such as projection of the release agent or separation of surface layers is observed. The measurement results of the thus-prepared black toner (TK2H) are summarized in Table 1 below.

Preparation of Black Developer (DK2H)

The black developer (DK2H) is prepared in a manner similar to that in the "Preparation of black developer (DK1L)" except that the black toner (TK2H) is used instead of the black toner (TK1L).

Preparation of Black Replenishing Developer (SDK2H)

The black replenishing developer (SDK2H) is prepared in a manner similar to that in the "Preparation of black replenishing developer (SDK1L)" except that the black toner (TK2H) is used instead of the black toner (TK1L).

Example 3

In Example 3, for high-gloss images, the black toner (TK1L), the black developer (DK1L), and the black replenishing developer (SDK1L), which are the same as those in Example 1, are used. Hereinafter, a black toner (TK3H), a black developer (DK3H), and a black replenishing developer (SDK3H) for low-gloss images will be described.

Preparation of Black Toner (TK3H)

Amorphous polyester resin particle dispersion (PA1): 200 parts by mass

Amorphous polyester resin particle dispersion (PA2): 450 parts by mass

Crystalline polyester resin particle dispersion (PC1): 55 parts by mass

Coloring agent dispersion (PK1): 90 parts by mass

Release agent dispersion (W1): 130 parts by mass

Ion-exchanged water: 250 parts by mass

These components are charged into a 3-liter reaction vessel equipped with a thermometer, a pH meter, and a stirrer. The pH of the resultant mixture is adjusted at 25° C. to 3.0 with nitric acid. Then, while the resultant mixture is dispersed with a homogenizer (ULTRA-TURRAX T50, manufactured by IKA JAPAN) at 5,000 rpm, 140 parts by mass of the prepared aluminum sulfate aqueous solution (SA) is added to the mixture and dispersed for 6 minutes.

After that, a stirrer and a mantle heater are attached to the reaction vessel. While the number of revolutions of the stirrer is adjusted such that the resultant slurry is sufficiently stirred, the slurry is heated to 40° C. at a heating rate of 0.2° C./min and then to a temperature more than 40° C. at a heating rate of 0.05° C./min. In this process, the particle size is measured with a Multisizer II (manufactured by Beckman Coulter, Inc., aperture size: 50 μm) every 10 minutes. When the volume average particle size has reached 5.5 μm, the temperature of the slurry is maintained. Then, the entirety of the additional amorphous polyester resin particle dispersion (PA2A) is added to the slurry over 60 minutes.

The pH of the slurry is then adjusted to 9.5 with an aqueous solution of sodium hydroxide. After that, the slurry is heated to 97° C. at a heating rate of 1° C./min and the slurry is maintained at 97° C. The shape and surface properties of the particles are observed with an optical microscope and a scanning electron microscope (FE-SEM) and the circularity of the particles is measured with a circularity measurement device (FPIA-3000, manufactured by SYSMEX CORPORATION) every 15 minutes. When the circularity has reached a desired value, the pH of the slurry is adjusted to 9.0 with an aqueous solution of sodium hydroxide and left for 5 minutes. Then, the vessel is cooled to 30° C. with cooling water over 5 minutes.

The thus-cooled slurry is passed through a nylon mesh having 15 μm openings so that coarse particles are removed. The resultant toner slurry is filtrated with an aspirator under reduced pressure. Then, the resultant toner is subjected to a process of filtration with ion-exchanged water at 30° C. The toner is washed by repeating this process until the conductivity of the filtrate becomes 10 μS/cm or less.

The thus-washed toner is pulverized with a wet-dry particle sizing apparatus (COMIL) into fine particles and subjected to vacuum drying in an oven at 35° C. for 36 hours to provide toner particles. These toner particles are mixed with 1.0 part by mass of hydrophobic silica (RY50 manufactured by NIPPON AEROSIL CO., LTD.) and 0.8 parts by mass of hydrophobic titanium oxide (T805 manufactured by NIPPON AEROSIL CO., LTD.) with respect to 100 parts by mass of the toner particles. The resultant mixture is blended with a sample mill at 13,000 rpm for 30 seconds. After that, the resultant mixture is sifted with an oscillating sieve having 45 gm openings. Thus, the black toner (TK3H) for low-gloss images is provided.

The thus-prepared black toner (TK3H) has a volume average particle size $D_{50V}$ of 6.4 μm and a circularity of 0.961 (FPIA-3000 manufactured by SYSMEX CORPORATION). An SEM image of the toner is observed. As a result, the toner particles have smooth surfaces and no defect such as projection of the release agent or separation of surface layers is observed. The measurement results of the thus-prepared black toner (TK3H) are summarized in Table 1 below.

Preparation of Black Developer (DK3H)

The black developer (DK3H) is prepared in a manner similar to that in the "Preparation of black developer (DK1H)" except that the black toner (TK3H) is used instead of the black toner (TK1H).

Preparation of Black Replenishing Developer (SDK3H)

The black replenishing developer (SDK3H) is prepared in a manner similar to that in the "Preparation of black replenishing developer (SDK1H)" except that the black toner (TK3H) is used instead of the black toner (TK1H).

Comparative Example 1

Preparation of Black Toner (TK10L)

Amorphous polyester resin (B1): 121 parts by mass

Crystalline polyester resin (C1): 75 parts by mass

Carbon black (R330, manufactured by Cabot Corporation): 45 parts by mass

Hydrocarbon wax (trade name: FNP 0090, manufactured by NIPPON SEIRO CO., LTD., melting temperature Tw: 90.2° C.): 45 parts by mass Aromatic hydrocarbon resin (FMR, manufactured by Mitsui Chemicals, Inc.): 45 parts by mass These components are molten and kneaded with a BR Banbury kneader (manufactured by Kobe Steel, Ltd.) at 120 rpm for about 8 minutes, then mixed with 80 parts of purified carnauba wax (NISSEI CORPORATION), and further molten kneaded for about 7 minutes. The resultant kneaded product is formed so as to have the shape of a plate having a thickness of about 1 cm with a reduction roller. This plate is roughly pulverized into the size of about several millimeters with a FitzMill-type pulverizing apparatus, then finely pulverized with an IDS-type pulverizing apparatus, and then classified with an Elbow-type classifying apparatus. Thus, a black toner (TK10L) is provided. The measurement results of the thus-prepared black toner (TK10L) are summarized in Table 1 below.

Preparation of Black Developer (DK10L)

A black developer (DK10L) is prepared in a manner similar to that in the "Preparation of black developer (DK1L)" except that the black toner (TK10L) is used instead of the black toner (TK1L).

Preparation of Black Replenishing Developer (SDK10L)

A black replenishing developer (SDK10L) is prepared in a manner similar to that in the "Preparation of black replenishing developer (SDK1L)" except that the black toner (TK10L) is used instead of the black toner (TK1L).

Preparation of Black Toner (TK10H)

A black toner (TK10H) is prepared in a manner similar to that in the "Preparation of black toner (TK10L)" except that the amorphous polyester resin (B1) is changed to the amorphous polyester resin (B2). The measurement results of the thus-prepared black toner (TK10H) are summarized in Table 1 below.

Preparation of Black Developer (DK10H)

A black developer (DK10H) is prepared in a manner similar to that in the "Preparation of black developer (DK1H)" except that the black toner (TK10H) is used instead of the black toner (TK1H).

Preparation of Black Replenishing Developer (SDK10H)

A black replenishing developer (SDK10H) is prepared in a manner similar to that in the "Preparation of black replenishing developer (SDK1H)" except that the black toner (TK10H) is used instead of the black toner (TK1H).

TABLE 1

| | | Example 1 | Example 2 | Example 3 | Comparative example 1 | Comparative example 2 |
|---|---|---|---|---|---|---|
| High-gloss image toner | Black toner symbol | TK1L | TK1L | TK1L | TK10L | TK1L |
| | Volume average particle size (μm) | 6.0 | 6.0 | 6.0 | 8.0 | 6.0 |
| | Shape factor (circularity) | 0.965 | 0.965 | 0.965 | 0.948 | 0.965 |
| | Flow tester 1/2 effluent temperature (° C.) | 108 | 108 | 108 | 104 | 108 |
| | Aluminum amount *1 | 0.025 | 0.025 | 0.025 | — | 0.025 |
| | Sodium amount *2 | 0.22 | 0.22 | 0.22 | — | 0.22 |
| Low-gloss image toner | Black toner symbol | TK1H | TK2H | TK3H | TK10H | TK11H |
| | Volume average particle size (μm) | 6.1 | 6.4 | 6.4 | 8.4 | 6.0 |
| | Shape factor (circularity) | 0.960 | 0.959 | 0.961 | 0.945 | 0.961 |
| | Flow tester 1/2 effluent temperature (° C.) | 130 | 133 | 125 | 114 | 112 |
| | Aluminum amount *1 | 0.23 | 0.24 | 0.18 | — | 0.024 |
| | Sodium amount *2 | 0.24 | 0.21 | 0.3 | — | 0.21 |

*1: Net intensity of aluminum measured with fluorescent X-ray

*2: Net intensity of sodium measured with fluorescent X-ray

Evaluation Test

The black toners, the black developers, and the black replenishing developers in Examples 1 to 3 and Comparative examples 1 and 2 are subjected to the following fixing evaluation test.

A modified apparatus is prepared by removing a fixing device from an image forming apparatus (DocuCentre Color 400 CP, manufactured by Fuji Xerox Co., Ltd.). Then, the modified apparatus is installed in an environment chamber where the temperature is 25° C. and the humidity is 60%.

In the modified apparatus, a developer and a toner that are provided as standard supplies are respectively removed from a cyan developing device and a cyan toner cartridge and the cyan developing device and the cyan toner cartridge are sufficiently cleaned. Then, as summarized in Table 2 below, in the tests for Examples and Comparative examples, the cyan developing device is charged with corresponding black developers for high-gloss images and the cyan toner cartridge is charged with corresponding black replenishing developers for high-gloss images.

Then, a developer and a toner that are provided as standard supplies are respectively removed from a magenta developing device and a magenta toner cartridge and the magenta developing device and the magenta toner cartridge are sufficiently cleaned. Then, as summarized in Table 2 below, in the tests for Examples and Comparative examples, the magenta developing device is charged with corresponding black developers for low-gloss images and the magenta toner cartridge is charged with corresponding black replenishing developers for low-gloss images.

Before the developers and the replenishing developers are thus charged into the apparatus, the apparatus is sufficiently cleaned.

Then, 20 sheets of A3 paper ($C^2$, manufactured by Fuji Xerox Co., Ltd.; hereafter, A3 paper is the same product) are passed through the apparatus without development and, in this state, the apparatus is left for 48 hours. Then, 10 sheets of A3 paper are passed through the apparatus without development and single-color solid images having a size of 5 cm×5 cm and a development toner amount of 7.0 g/$m^2$ are subsequently formed on OK Prince 127 GSM (g/$m^2$) sheets (manufactured by Fuji Xerox Co., Ltd.) for each toner. Since the fixing device has been removed, the resultant images are in the state of unfixed.

These sheets including the unfixed images are passed through the fixing device having been removed from the DocuCentre Color 400 CP at a processing speed of 100 mm/s while the fixing temperature is changed from 100° C. to 200° C. in steps of 5° C. Thus, the unfixed images are fixed.

The image surface of each resultant fixed image is inwardly folded and the degree of peeling of the image at the folded portion is observed. Thus, the minimum fixing temperature at which substantially no image peeling occurs is determined. Then, evaluation is performed in accordance with the following criteria. When the difference in the fixing temperatures of two toners is 0° C., the evaluation result is "Good"; when the difference is 5° C., the evaluation result is "Fair"; and when the difference is 10° C. or more, the evaluation result is "Poor". When toners have an evaluation result of "Good" or "Fair", the toners are practically usable. The results are summarized in Table 2 below.

TABLE 2

| | | Example 1 | Example 2 | Example 3 | Comparative example 1 | Comparative example 2 |
|---|---|---|---|---|---|---|
| High-gloss images | Black toner | TK1L | TK1L | TK1L | TK10L | TK1L |
| | Back developer | DK1L | DK1L | DK1L | DK10L | DK1L |
| | Black replenishing developer | SDK1L | SDK1L | SDK1L | SDK10L | SDK1L |
| Low-gloss images | Black toner | TK1H | TK2H | TK3H | TK10H | TK11H |
| | Black developer | DK1H | DK2H | DK3H | DK10H | DK11H |
| | Black replenishing developer | SDK1H | SDK2H | SDK3H | SDK10H | SDK11H |
| Fixing test evaluation result | | Good | Fair | Good | Poor | Poor |

Discussion of Results

The combinations of toners in Examples 1 to 3 satisfying conditions according to exemplary embodiments have small differences in the fixing temperatures and are versatile for various papers. This is probably because ionic crosslinking due to aluminum changes toner viscoelasticity in a region of temperature higher than the temperature corresponding to the minimum fixing temperature.

In contrast, in the low-gloss image toners in Comparative examples, ionic crosslinking due to aluminum is not formed but the molecular weights of the resins are increased. The distribution of viscoelastic relaxation time is larger in the resins than in ionic crosslinking. Thus, probably because the toner viscoelasticity is high in a region of temperature lower than the temperature corresponding to the minimum fixing temperature, the fixing temperature is increased.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an electrostatic-latent-image holding member;

a charging unit that charges the electrostatic-latent-image holding member;

an electrostatic-latent-image forming unit that forms an electrostatic latent image on a surface of the charged electrostatic-latent-image holding member;

a plurality of developing units that each supply a developer containing a toner to the electrostatic latent image formed on the surface of the electrostatic-latent-image holding member and form a toner image;

a transfer unit that transfers the toner image onto a recording medium to form a transfer image; and a fixing unit that fixes the transfer image, wherein the plurality of developing units separately contain a toner A and a toner B that satisfy relationships (1) and (2) below and have similar colors;

the toner A includes a binder resin containing a polyester about 90 mass % or more of the binder resin, the polyester contains an amorphous polyester having an alkyl side chain and a crystalline polyester, and when a glass transition temperature of the amorphous polyester is defined as Tga, the crystalline polyester has a melting temperature Tma of about (Tga+10)° C. or more and about (Tga+30)° C. or less;

the toner B contains a binder resin containing a polyester about 90 mass % or more of the binder resin, the polyester contains an amorphous polyester having an alkyl side chain and a crystalline polyester, and when a glass transition temperature of the amorphous polyester is defined as Tgb, the crystalline polyester has a melting temperature Tmb of about (Tgb+10)° C. or more and about (Tgb+30)° C. or less; and about 90 mass % of the binder resin of the toner A and about 90 mass % of the binder resin of the toner B are the same resin;

(1) relationship of Ta>Tb where Ta represents a flow tester ½ effluent temperature of the toner A and Tb represents a flow tester ½ effluent temperature of the toner B; and (2) relationship of Aa>Ab where Aa represents an amount of an aluminum (with reference to net intensity) in the toner A measured with fluorescent X-ray and Ab represents an amount of an aluminum (with reference to net intensity) in the toner B measured with fluorescent X-ray.

2. The image forming apparatus according to claim 1, wherein the toner A and the toner B further satisfy a relationship (3) below, (3) relationship of Naa>Nab where Naa represents an amount of a sodium in the toner A measured with fluorescent X-ray and Nab represents an amount of a sodium in the toner B measured with fluorescent X-ray.

3. The image forming apparatus according to claim 1, wherein the similar colors of the toner A and the toner B are selected from black, cyan, magenta, and yellow.

4. The image forming apparatus according to claim 3, wherein the similar colors of the toner A and the toner B are black.

5. The image forming apparatus according to claim 1, wherein the melting temperature Tma and the melting temperature Tmb are about 50° C. or more and about 120° C. or less.

6. The image forming apparatus according to claim 1, wherein the glass transition temperature Tga and the glass transition temperature Tgb are about 45° C. or more and about 70° C. or less.

7. The image forming apparatus according to claim 1, wherein a content of the amorphous polyester in the binder resin is about 60 mass % or more.

8. An image forming method comprising performing a plurality of developments with a toner A and a toner B that satisfy relationships (1) and (2) below and have similar colors, wherein the toner A includes a binder resin containing a polyester about 90 mass % or more of the binder resin, the polyester contains an amorphous polyester having an alkyl side chain and a crystalline polyester, and when a glass transition temperature of the amorphous polyester is defined as Tga, the crystalline polyester has a melting temperature Tma of about (Tga+10)° C. or more and about (Tga+30)° C. or less;

the toner B contains a binder resin containing a polyester about 90 mass % or more of the binder resin, the polyester contains an amorphous polyester having an alkyl side chain and a crystalline polyester, and when a glass transition temperature of the amorphous polyester is defined as Tgb, the crystalline polyester has a melting temperature Tmb of about (Tgb+10)° C. or more and about (Tgb+30)° C. or less; and about 90 mass % of the binder resin of the toner A and about 90 mass % of the binder resin of the toner B are the same resin;

(1) relationship of Ta>Tb where Ta represents a flow tester ½ effluent temperature of the toner A and Tb represents a flow tester ½ effluent temperature of the toner B; and (2) relationship of Aa>Ab where Aa represents an amount of an aluminum (with reference to net intensity) in the toner A measured with fluorescent X-ray and Ab represents an amount of an aluminum (with reference to net intensity) in the toner B measured with fluorescent X-ray.

9. The image forming method according to claim 8, wherein the toner A and the toner B further satisfy a relationship (3) below, (3) relationship of Naa>Nab where Naa represents an amount of a sodium in the toner A measured with fluorescent X-ray and Nab represents an amount of a sodium in the toner B measured with fluorescent X-ray.

10. The image forming method according to claim 8, wherein the similar colors of the toner A and the toner B are selected from black, cyan, magenta, and yellow.

11. The image forming method according to claim 10, wherein the similar colors of the toner A and the toner B are black.

12. The image forming method according to claim 8, wherein the melting temperature Tma and the melting temperature Tmb are about 50° C. or more and about 120° C. or less.

13. The image forming method according to claim 8, wherein the glass transition temperature Tga and the glass transition temperature Tgb are about 45° C. or more and about 70° C. or less.

14. The image forming method according to claim 8, wherein a content of the amorphous polyester in the binder resin is about 60 mass % or more.

* * * * *